US008229339B2

(12) United States Patent
Nanjo

(10) Patent No.: US 8,229,339 B2
(45) Date of Patent: Jul. 24, 2012

(54) FIXING DEVICE AND IMAGE FORMING APPARATUS INCLUDING SAME

(75) Inventor: Yuzuru Nanjo, Osaka (JP)

(73) Assignee: Kyocera Mita Corporation (JP)

( * ) Notice: Subject to any disclaimer, the term of this patent is extended or adjusted under 35 U.S.C. 154(b) by 329 days.

(21) Appl. No.: 12/764,198

(22) Filed: Apr. 21, 2010

(65) Prior Publication Data

US 2010/0272482 A1 Oct. 28, 2010

(30) Foreign Application Priority Data

Apr. 24, 2009 (JP) ..... 2009-105794

(51) Int. Cl.
*G03G 15/20* (2006.01)

(52) U.S. Cl. ..... 399/328; 399/329; 219/216

(58) Field of Classification Search ..... 399/328–329; 219/216
See application file for complete search history.

(56) References Cited

U.S. PATENT DOCUMENTS

| | | | | |
|---|---|---|---|---|
| RE36,962 | E | 11/2000 | Higashi et al. | |
| 2009/0175664 | A1* | 7/2009 | Nanjo et al. | 399/330 |
| 2010/0028061 | A1* | 2/2010 | Nanjo et al. | 399/328 |

FOREIGN PATENT DOCUMENTS

| | | |
|---|---|---|
| JP | 6-318001 | 11/1994 |
| JP | 2003-107941 | 4/2003 |
| JP | 3527442 | 2/2004 |

* cited by examiner

*Primary Examiner* — David Gray
*Assistant Examiner* — G. M. Hyder
(74) *Attorney, Agent, or Firm* — Gerald E. Hespos; Michael J. Porco

(57) ABSTRACT

A fixing device includes a heating member, a pressing member, a coil, a magnetic core, a path switching member switching a magnetic path between a first path and a second path, and a magnetism adjustment member. The magnetism adjustment member allows a passage of a magnetic flux from the magnetic core towards the heating member within the magnetic field range when the magnetic field path is switched to the first path, and shields the magnetic flux without allowing the passage of the magnetic flux within the magnetic field range when the magnetic path is switched to the second path. Further, the magnetism adjustment member has a plurality of ring-shaped portions formed of a single wire material having an endless shape. Each of the ring-shaped portions extends in a longitudinal direction of the magnetic core according to a size of the sheet.

18 Claims, 24 Drawing Sheets

ENTIRE SURFACE SHIELDING (0°)

NO SHIELDING (60°)

INTERMEDIATE- AND SMALL-SIZE SHIELDING (120°)

NO SHIELDING (180°)

INTERMEDIATE SIZE SHIELDING (240°)

FIXING DEVICE AND IMAGE FORMING APPARATUS INCLUDING SAME

BACKGROUND OF THE INVENTION

1. Field of the Invention

The present invention relates to a fixing device that heats and melts an unfixed toner and fixes the toner to a sheet, while passing the sheet carrying the toner image by nipping between a pair of heated rollers or a heating belt and a roller, and also to an image forming apparatus in which the fixing device is installed.

2. Description of the Related Art

In the image forming apparatuses of the aforementioned kind, a belt system in which a low thermal capacity can be set has recently attracted attention due to a demand for a short warm-up time and reduced energy consumption in the fixing device. An electromagnetic inductive heating system (IH) that enables rapid heating and high-efficiency heating has also attracted attention in recent years, and a large number of products in which the electromagnetic inductive heating is combined with the belt system to reduce energy consumption when fixing color images have been produced. When the belt system is combined with electromagnetic inductive heating, the electromagnetic inductive units are in most cases disposed outside the belt because such a configuration (so-called external inductive heating IH) ensures simple coil layout and cooling and enables direct heating of the belt.

A variety of techniques have been disclosed for preventing an excessive increase in temperature in the sheet non-passage area according to a width of sheet passing through the fixing device (sheet passage width). In particular, the below-described first prior art technique and second prior art technique are used as a size switching means in the external IH.

With the first prior art technique, a magnetic member is divided into a plurality of sections that are arranged side by side in the sheet passage width direction, and some of the magnetic members are withdrawn from or brought closer to an excitation coil according to the sheet size (sheet passage width). In this case, in the sheet non-passage area, the magnetic members are withdrawn from the excitation coil to decrease heat generation efficiency, and the amount of generated heat is reduced with respect to that of the area corresponding to the sheet of the minimum sheet passage width.

With the second prior art technique, a separate electrically conductive member is disposed outside the minimum sheet passage width inside a heat-generating roller, and the position of the electrically conductive member is switched from that inside to that outside the magnetic field range. With such a prior art technique, the electrically conductive member is initially positioned outside the magnetic field range, the heat-generating roller is electromagnetically inductively heated, and where the heat-generating roller rises to a temperature close to a Curie temperature, the electrically conductive member is moved into the magnetic field range, whereby the magnetic flux is prevented from leaking from the heat-generating roller outside the minimum sheet passage width and an excess increase in temperature is prevented.

However, with the size switching means based on the above-described first prior art technique and second prior art technique, the effect of inhibiting an excessive increase in temperature has to be further improved over the presently attained one in order to increase productivity. For example, in order to improve the effect of inhibiting an excessive increase in temperature over the presently attained one with the second prior art technique, the surface area of the electrically conductive member that conducts magnetic shielding may be increased over the presently used one.

However, where the increase in surface area of the electrically conductive member is too large, the electrically conductive member is difficult to withdraw completely from the magnetic field range, and even if the larger portion is withdrawn to the outside of the magnetic field range, the remaining portion still can affect the magnetic field. Therefore, from the standpoint of increasing the effect of inhibiting an excessive increase in temperature, the expansion of surface area of the electrically conductive member is limited.

When this problem is resolved, it is undesirable to arrange in a row a plurality of individual electrically conductive members that shield a magnetic field. This is because where a space is formed between the adjacent electrically conductive members, no magnetic shielding effect is demonstrated in this space, a magnetic field leakage channel can be formed, and the fixing device is increased in size.

SUMMARY OF THE INVENTION

It is an object of the present invention to resolve the above-described problems and provide a fixing device that can further increase a magnetic shielding effect and an image forming apparatus having the fixing device installed therein.

In order to attain the above-described object, the fixing device according to one aspect of the present invention includes a heating member, a pressing member, the heating member and the pressing member fixing a toner image to a sheet by heat from the heating member while conveying the sheet having the toner image transferred thereto in a sandwiched state, a coil arranged along an outer surface of the heating member and generating a magnetic field to induction heat the heating member, a magnetic core arranged around the coil to form a magnetic path between the heating member and the magnetic core, and guiding the magnetic field generated by the core to the heating member, a path switching member switching the magnetic path between a first path in which the induction heating of the heating member is promoted and a second path in which the induction heating of the heating member is inhibited, and a magnetism adjustment member fixedly arranged over a range of the magnetic field including the first path and the second path. The magnetism adjustment member is configured to allow a passage of a magnetic flux from the magnetic core towards the heating member within the magnetic field range when the magnetic path is switched by the path switching member to the first path, and to shield the magnetic flux without allowing the passage of the magnetic flux within the magnetic field range when the magnetic path is switched to the second path. The magnetism adjustment member has a plurality of ring-shaped portions that are formed from a single wire material having an endless shape. Each of the ring-shaped portions extends in a longitudinal direction of the magnetic core according to a size of the sheet.

DETAILED DESCRIPTION OF THE PREFERRED EMBODIMENTS

Figure 1:
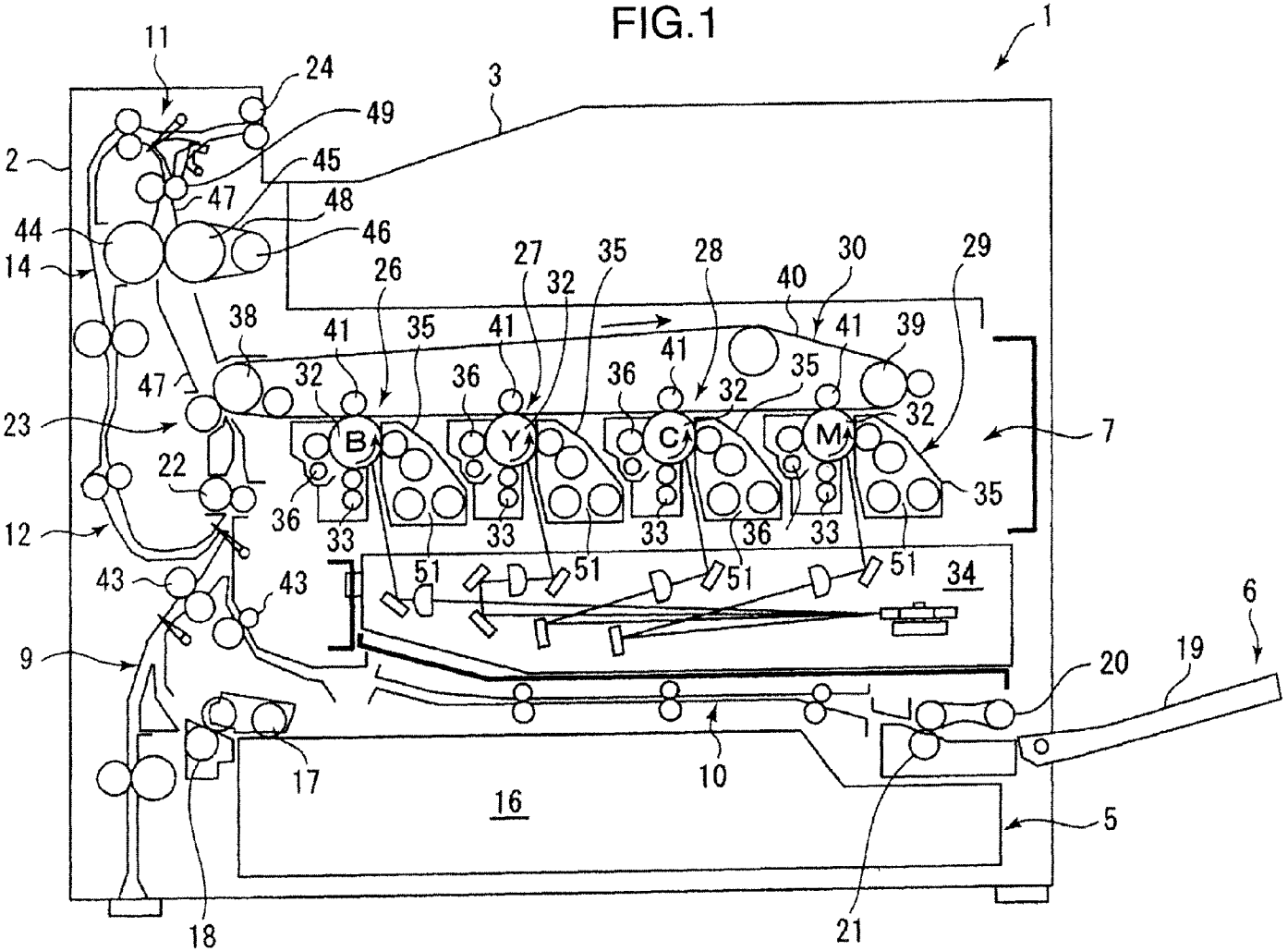
FIG. 1 is a schematic drawing illustrating the configuration of an image forming apparatus of one embodiment.

An embodiment of the present invention will be described below in greater detail with reference to the appended drawings. FIG. 1 is a schematic diagram illustrating the configuration of an image forming apparatus 1 of one embodiment. The image forming apparatus 1 can be in the form of a printer, copier, facsimile device, or an all-in-one device combining the functions of the aforementioned devices in which, for example, a toner image is transferred and printing is conducted on the surface of a printing medium such as printing sheet on the basis of image information inputted from the outside.

The image forming apparatus 1 shown in FIG. 1 is, for example, a tandem color printer. The image forming apparatus 1 is provided inside thereof with a quadrangular box-like apparatus main body 2 in which a color image is formed (printed) on the sheet. A discharge tray 3 for discharging the sheet on which the color image has been printed is provided in the upper surface portion of the apparatus main body 2. A sheet feed cassette 5 that stores sheet is installed in the lower inside the apparatus main body 2. A stack tray 6 for manually feeding the sheet is installed in the central portion of the apparatus main body 2. An image forming section 7 is provided in the upper portion of the apparatus main body 2. The image forming section 7 forms an image on the sheet on the basis of image data such as text or pictures sent from outside the apparatus.

As shown in FIG. 1, a first conveying path 9 that conveys the sheet that has been fed from the sheet feed cassette to the image forming section 7 is installed in the left portion of the apparatus main body 2, and a second conveying path 10 that conveys the sheet that has been fed from the stack tray 6 to the image forming section 7 is installed from the right portion to the left portion. Further, a fixing unit (fixing device) 14 that performs fixing process to the sheet on which the image has been formed in the image forming section 7 and a third conveying path 11 that conveys the sheet subjected to the fixing process to the discharge tray 3 are installed in the upper left portion inside the apparatus main body 2.

The sheet feed cassette 5 can be replenished by pulling out to the outside of the apparatus main body 2 (for example, to the front side in FIG. 1). The sheet feed cassette 5 is provided with a storing portion 16. The storing portion 16 can selectively store sheet of at least two kinds that differ in size in the sheet feed direction. The sheet stored in the storing portion 16 is fed, sheet by sheet, by a sheet feed roller 17 and a separation roller 18 to the first conveying path 9.

The stack tray 6 can be opened and closed at the outer surface of the apparatus main body 2, and sheet for manual feed is placed by one sheet or stacked by a plurality of sheets in a manual feed portion 19. The sheet placed into the manual feed portion 19 is fed, sheet by sheet, by a pickup roller 20 and a separation roller 21 to the second conveying path 10.

The first conveying path 9 and second conveying path 10 merge in front of a registration roller 22. The sheet that has been fed to the registration roller 22 waits herein for some time and is sent out to a secondary transfer section 23 after skew adjustment and timing adjustment. In the secondary transfer section 23, a full-color toner image transferred on an intermediate transfer belt 40 is secondary transferred onto the sheet that has been sent out. Then, the sheet on which the toner image has been fixed in the fixing unit 14 is reversed, if necessary, in a fourth conveying path 12, and a full-color toner image is secondary transferred in the secondary transfer section 23 on the side that is opposite the side on which the image has been initially formed. The toner image on the opposite surface is then fixed in the fixing unit 14 and discharged by the discharge roller 24 to the discharge tray 3 via the third conveying path 11.

The image forming section 7 is provided with four image forming units 26 to 29 that form toner images of black (B), yellow (Y), cyan (C), and magenta (M) colors and also with an intermediate transfer unit 30 that combines and supports the toner images of all colors that have been formed in these image forming units 26 to 29.

Each image forming unit 26 to 29 has a photosensitive drum 32, a charging unit 33 installed opposite the circumferential surface of the photosensitive drum 32, a laser scanning unit 34 radiating with a laser beam a specific position on the circumferential surface of the photosensitive drum 32 downstream of the charging unit 33, a development unit 35 located downstream of the radiation position of the laser beam from the laser scanning unit 34 and installed opposite the circumferential surface of the photosensitive drum 32, and a cleaning unit 36 located downstream of the development unit 35 and installed opposite the circumferential surface of the photosensitive drum 32.

The photosensitive drums 32 of the image forming units 26 to 29 are rotated in the counterclockwise direction (as shown in the figure) by a drive motor that is not shown in the figure. Toner boxes 51 in the development unit 35 of the image forming units 26 to 29 contain a black toner, a yellow toner, a cyan toner, and a magenta toner.

The intermediate transfer unit 30 is provided with a rear roller 38 that is installed close to the image forming unit 26, a front roller 39 that is installed close to the image forming unit 29, an intermediate transfer belt 40 stretched between the rear roller 38 and front roller 39, and four transfer rollers 41 that can be pressed against the photosensitive drum 32 of the image forming units 26 to 29 through the intermediate transfer belt 40 at a position downstream of the development unit 35.

In the intermediate transfer unit 30, the toner images of all colors are transferred on the intermediate transfer belt 40 in a superimposed manner at positions of the transfer rollers of the image forming units 26 to 29 and eventually a full color toner image is obtained on the intermediate transfer belt 40.

The first conveying path 9 or second conveying path 10 convey the sheet that has been out from the sheet feed cassette 5 or stack tray 6 to the intermediate transfer unit 30 and are provided with a plurality of conveying rollers 43 installed in predetermined locations inside the apparatus main body 2 and the registration roller 22 for timing an image forming operation and a sheet feed operation in the image forming section 7, the registration roller being installed in front of the intermediate transfer unit 30.

In the fixing unit 14, a process of fixing an unfixed toner image on the sheet is conducted by heating and pressing the sheet onto which the toner image has been transferred in the image forming section 7. The fixing unit 14 is provided, for example, with a roller sheet composed of a pressing roller (pressing member) 44 of a heating type and a fixing roller 45. The pressing roller 44 is manufactured, for example, from a metal, and the fixing roller 45 has a metal core, an elastic surface layer (for example, a silicone sponge), and a mold releasing layer (for example, PFA). Further, a heat roller 46 is provided adjacently to the fixing roller 45, and a heating belt (heating member) 48 is stretched over the heat roller 46 and fixing roller 45. The heating belt 48 and pressing roller fix the toner image on the sheet by heat from the heating belt 48, while conveying therebetween the sheet onto which the toner image has been transferred. The structure of the fixing unit 14 will be explained below in greater detail.

Respective conveying paths 47 are provided upstream and downstream of the fixing unit 14, as viewed in the sheet conveying direction, and the sheet that has been conveyed through the intermediate transfer unit 30 is introduced into a nip between the pressing roller 44 and fixing roller 45 through the upstream conveying path 47. The sheet that has passed between the pressing roller 44 and fixing roller 45 is guided into the third conveying path 11 via the downstream conveying path 47.

The sheet that has been subjected to the fixing process in the fixing unit 14 is conveyed to the discharge tray 3 via the third conveying path 11. For this purpose, a conveying roller 49 is disposed in an appropriate position in the third conveying path 11, and the aforementioned discharge roller 24 is installed in the outlet of the third conveying path.

First Embodiment

Figure 2:
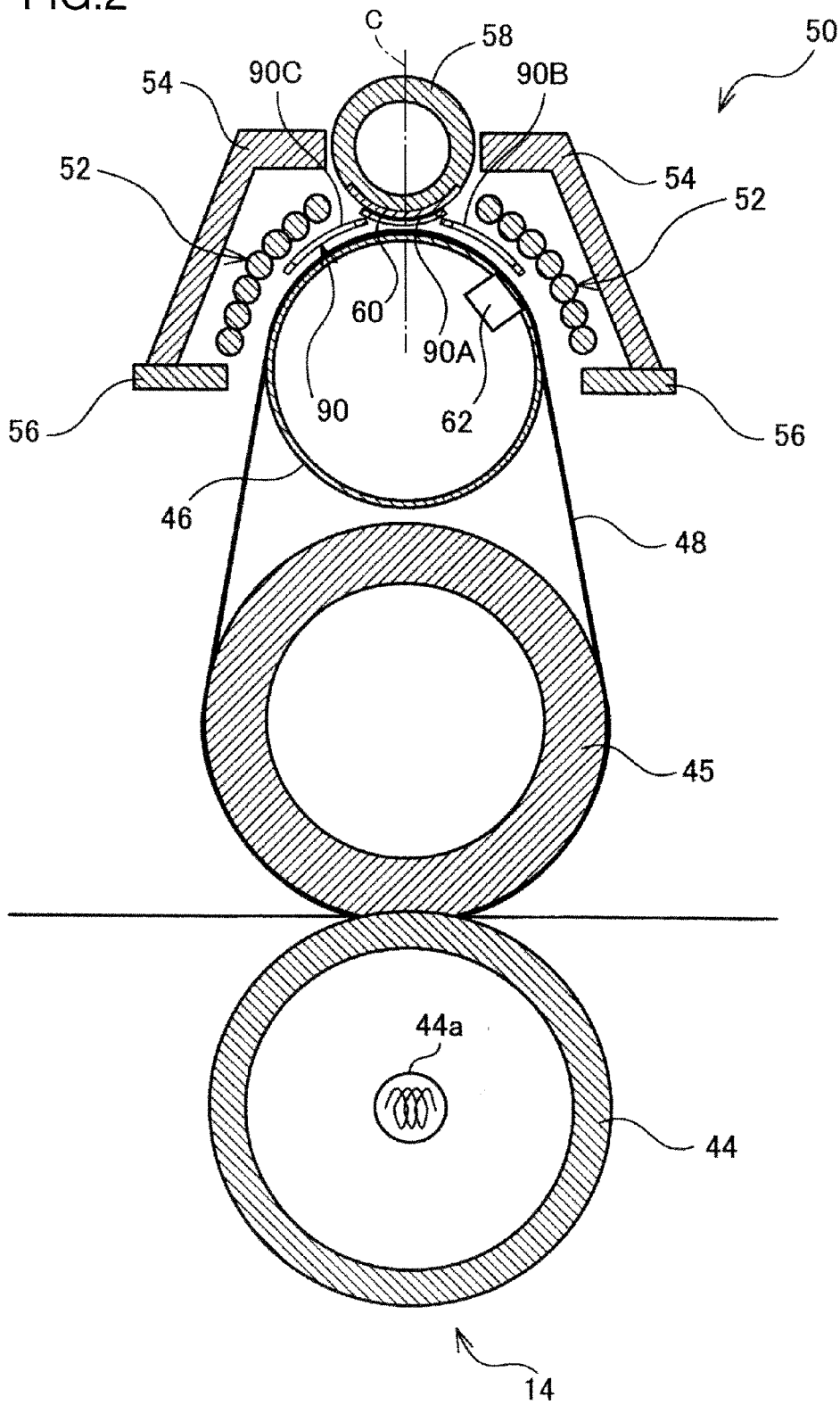
FIG. 2 is a vertical sectional view illustrating the first embodiment of the fixing unit.

FIG. 2 is a vertical sectional view illustrating a structural example of the fixing unit 14. FIG. 2 shows a state obtained by rotating the orientation counterclockwise through about 90° from a state in which the fixing unit is mounted on the image forming apparatus 1. Therefore, the sheet conveying direction from below upward, as viewed in FIG. 1, becomes from right to left in FIG. 2. In the case of a larger apparatus main body 2 (all-in-one device), the mounting can be performed with the orientation shown in FIG. 2.

The fixing unit 14 of the present embodiment is provided with the pressing roller 44 with a diameter of, for example, 50 mm, the fixing roller 45 with a diameter of, for example, 45 mm, the heat roller 46 with a diameter of, for example, 30 mm, and the heating belt 48 with a thickness of, for example, 35 μm (1 μm=$1\times10^{-6}$ m). The belt 48 is adjusted to a temperature range of, for example, 150 to 200° C. As described hereinabove, the fixing roller 45 has an elastic layer of silicon sponge on the surface. Therefore, a flat nip is formed between the heating belt 48 and fixing roller 45.

The heating belt 48 has a substrate from a ferromagnetic material (for example, Ni), and a thin elastic layer (for example, silicone rubber) is formed as the surface layer. A mold releasing layer (for example, PFA) is formed on the outer surface of the elastic layer. When the heating belt 48 is not imparted with heat generation function, a resin belt from PI or the like may be used. The heat roller 46 has a core from a magnetic metal (for example, Fe, SUS), and a mold releasing layer (for example, PFA) is formed on the surface thereof.

The pressing roller 44 will be described below in greater detail. For example, Fe or Al is used for the metal core, a Si rubber layer is formed on the core, and a fluororesin is formed as the surface layer. A configuration in which, for example, a halogen heater 44*a* is provided inside the pressing roller 44 may be also used.

Further, the fixing unit 14 also includes an IH coil unit 50 on the outside of the heat roller 46 and heating belt 48. The IH coil unit 50 includes an inductive heating coil 52, a pair of arch cores (magnetic core, first core) 54, a pair of side cores (magnetic core, first core) 56, and a center core (magnetic core, second core) 58.

[Coil]

In the example shown in FIG. 2, the inductive heating coil 52 is disposed on a virtual circular-arc surface along the circular-arc outer surface to conduct inductive heating in circular-arc portions of the heat roller 46 and heating belt 48. The configuration is actually such that a heat-resistant resin bobbin (not shown in the figure) from, for example, PPS, PET, or LCP is disposed on the outside of the heat roller 46 and heating belt 48, and the inductive heating coil 52 is wound around the bobbin. The bobbin is formed to have a semicylindrical shape along the outer surface of the heat roller 46, and the oil 52 is fixed to the bobbin, for example, with a silicone adhesive.

[Magnetic Core, First Core]

Referring to FIG. 2, the center core 58 is positioned in the center, and the arch cores 54 and side cores 56 are disposed so as to form pairs at both sides of the center core. The pair of arch cores 54 are ferrite cores molded to have mutually symmetrical arch-like cross sections. The total length of these cores is set to be larger than the winding area of the inductive heating coil 52 and the arch cores 54 are disposed at both sides of the winding center C of the inductive heating coil 52. The two side cores 56 are ferrite cores molded in a block-like shape. The two side cores 56 are connected to respective ends of (lower ends in FIG. 2) of the arch cores 54, and the side cores 56 cover the outside of the winding area of the inductive heating coil 52.

Among the above-described cores, the arch cores 54 are disposed, for example, in a plurality of locations with a spacing in the longitudinal direction of the heat core 46. Further, the side cores 56 are disposed continuously, without a spacing, in the longitudinal direction of the heat roller 46, and the entire length of the side cores 56 corresponds to the length of the winding area of the inductive heating coil 52. The arrangement of these cores 54, 56 is determined, for example, according to the magnetic flux density (magnetic field intensity) distribution of the inductive heating coil 52, and the side cores 56 compensate the magnetic field convergence effect and produce a uniform magnetic field density distribution (difference in temperature) in the longitudinal direction according to the arrangement of the arch cores 54 with a certain spacing in the sites where the arch cores are absent.

For example, a resin core holder (not shown in the figure) is provided outside the arch cores 54 and side cores 56 to obtain a structure in which the arch cores 54 and side cores 56 are supported by the core holder. The material of the core holder is preferably also a heat-resistant resin (for example, PPS, PET, and LCP).

Figure 8:
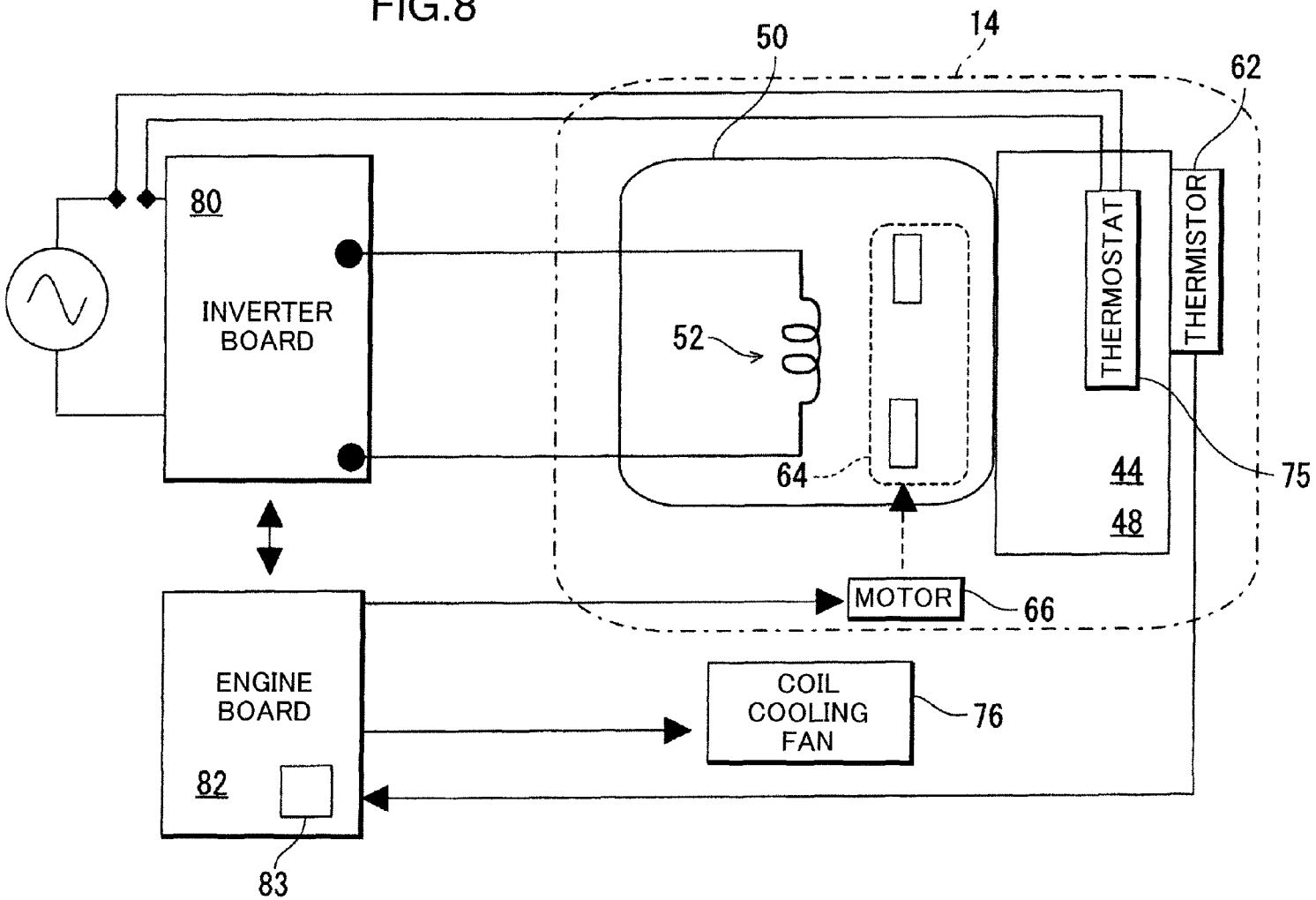
FIG. 8 is a block diagram of the fixing unit.

In the example shown in FIG. 2, a thermistor 62 (may be a thermostat 75 shown in FIG. 8) is disposed inside the heat roller 46. The thermistor 62 can be disposed inside the heat roller 46 in a location where the amount of heat generated by induction heating is especially large. As shown in FIG. 8, the temperature of the heat roller 46 is outputted to a main engine board 82. The board 82 is electrically connected to an inverter board 80, and the temperature of the heat roller 46 can be adjusted to a constant value by the thermostat 75. Further, the board 80 supplies electric power to the induction heating coil 52. The coil 52 is appropriately cooled by a cooling flow from a coil cooling fan 76, and a drive signal of the fan 76 is outputted from the engine board 82.

The board 82 has a function of driving a rotary mechanism 64 of the center core 58, for example, by outputting a drive signal to a stepping motor 66. More specifically, a rotation angle of the center core 58 can be controlled by the number of drive pulses applied to the motor 66, and the main engine board 82 is provided with a control unit 83 for conducting such a control. The control unit 83 can be constituted, for example, by a control IC, an input/output driver, and a semiconductor memory.

[Magnetic Core, Second Core]

Returning again to FIG. 2, the center core 58 is, for example, a ferrite core having a round cross-sectional shape. Similarly to the heat roller 46, the center core 58 has a length corresponding to a maximum passage width of 13 inch for sheet (for example, about 340 mm). When such sheet is used, an alternating current with a frequency of equal to or higher than 20 kHz (for example, an alternating current frequency of 30 kHz) is used and an audible range is avoided. Further, the center core 58 is linked to the rotary mechanism 64 and can be rotated about a longitudinal axis by the rotary mechanism 64 (this is not shown in FIG. 2).

[Shielding Member]

A shielding member (path switching member) 60 is attached to the center core 58 along the outer surface thereof. The shielding member 60 is in the form of a thin plate and is curved as a whole in a circular arc shape. The shielding member may be disposed, for example, in a state in which it is embedded in a thick portion of the center core 58, as shown in the figure, or may be disposed in a state in which it is bonded to the outer source of the center core 58. The shielding member 60 can be bonded, for example, by using a silicone adhesive.

The material of the shielding members 60 is preferably nonmagnetic and good in electrical conductivity. For example, oxygen-free copper or the like is used. The shielding members 60 shield by generating an opposite magnetic field by induction currents generated by the penetration of a perpendicular magnetic field through the ring parts of the shielding members and canceling an interlinkage magnetic flux (perpendicular penetrating magnetic field). Further, by using a good electrically conductive material, the generation of Joule heat by the induction currents is suppressed and the magnetic fields can be efficiently shielded. In order to improve electrical conductivity, it is effective, for example, (1) to select a material with as small a specific resistance as possible and (2) to increase the thickness of the members. Specifically, the thickness of the shielding members 60 is preferably 0.5 mm or larger and the shielding members 60 having a thickness of 1 mm are, for example, used in this embodiment.

If the shielding members 60 are located at positions (shielding positions) proximate to the outer surface of the heating belt 48 as shown in FIG. 2, magnetic resistance increases around the induction heating coil 52 to reduce magnetic field intensity. On the other hand, if the center core is rotated by 180° (direction is not particularly limited) from the state shown in FIG. 2 and the shielding members 60 are moved to most distant positions (retracted positions) from the heating belt 48, magnetic resistance decreases around the induction heating coil 52 and magnetic paths are formed through the arch cores 54 and the side cores 56 at the opposite sides with the center core 58 as a center, whereby a magnetic field acts on the heating belt 48 and the heat roller 46.

[Magnetism Adjustment Member]

In the IH coil unit 50, a magnetism adjustment member 90 is fixedly disposed within an area that spreads from a center between the center core 58 and heating belt 48 (heat roller 46) to opposite sides of the center between the inductive heating coil 52 and heating belt 48 (heat roller 46). An appropriate clearance that does not hinder the rotation of the center core 58 is ensured between the center core 58 (shielding member 60) and magnetism adjustment member 90.

Figure 3:
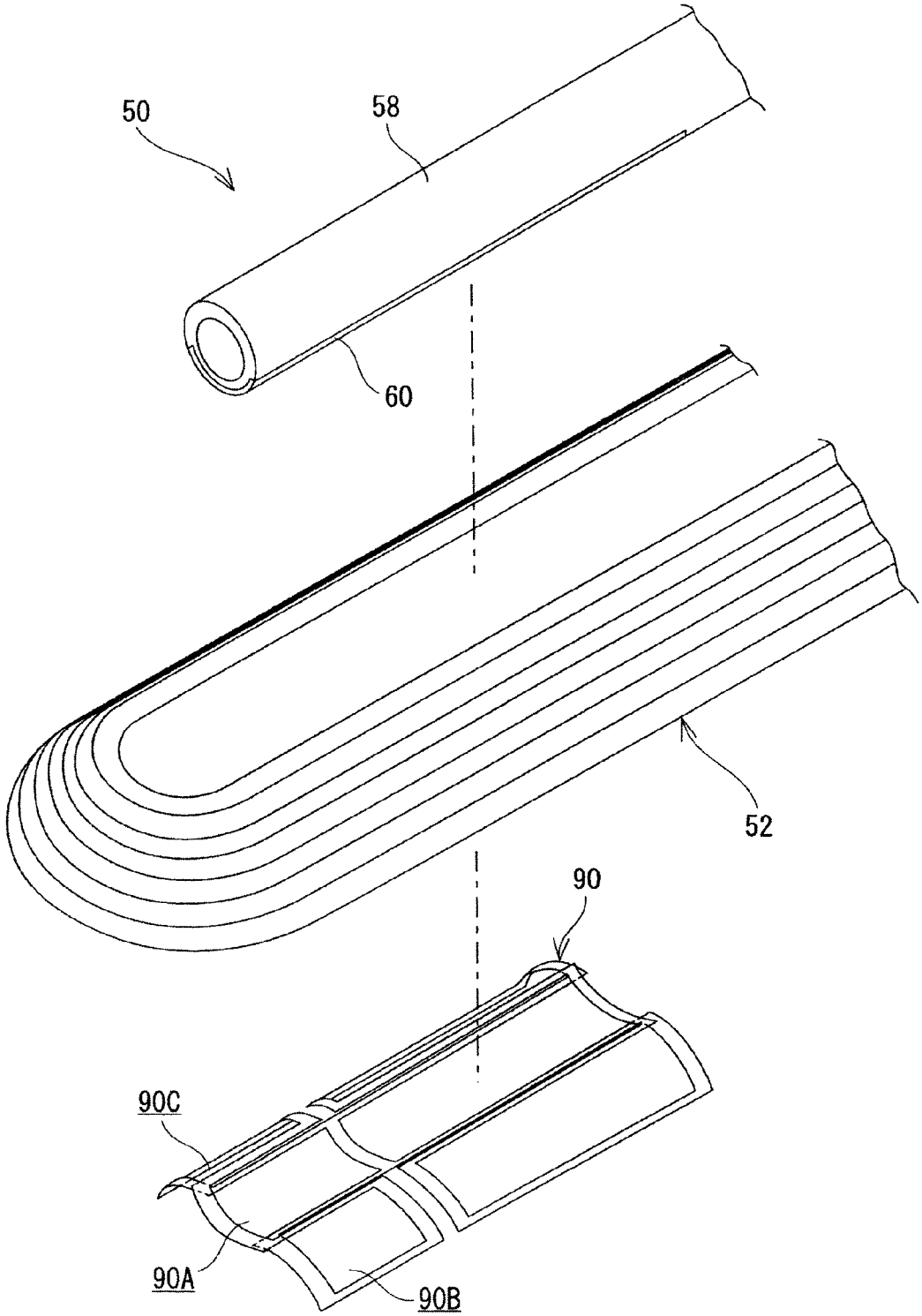
FIG. 3 is an exploded perspective view illustrating the mutual arrangement of a center core, a shielding member, an inductive heating coil, and a magnetism adjustment member.

FIG. 3 is an exploded perspective view illustrating the mutual arrangement of the center core 58, the shielding member 60, the coil 52, and the magnetism adjustment member 90. As described hereinabove, the center core 58 together with the heat roller 46 have a total length that is larger than the maximum sheet passage area (first sheet passage area) that has been set according to the maximum width of the sheet. Accordingly, the winding area of the inductive heating coil 52 spreads over a range that can cover this total length, as viewed in the longitudinal direction of the center core 58.

The shielding member 60 is disposed at both end portions of the center core 58, as viewed in the longitudinal direction thereof, and the magnetism adjustment member 90 is also disposed at both end portions of the center core 58 (or heat roller 46), as viewed in the longitudinal direction thereof (only one end portion is shown in FIG. 3). The shielding member 60 and magnetism adjustment member 90 are disposed outside the minimum sheet passage area (second sheet passage area) that has been set according to the minimum width size of the sheet used in the image forming apparatus 1. An intermediate sheet passage area corresponding to an intermediate width size of sheet is set between the maximum sheet passage area and minimum sheet passage area.

[Structural Example of Magnetism Adjustment Member]

Figure 4:
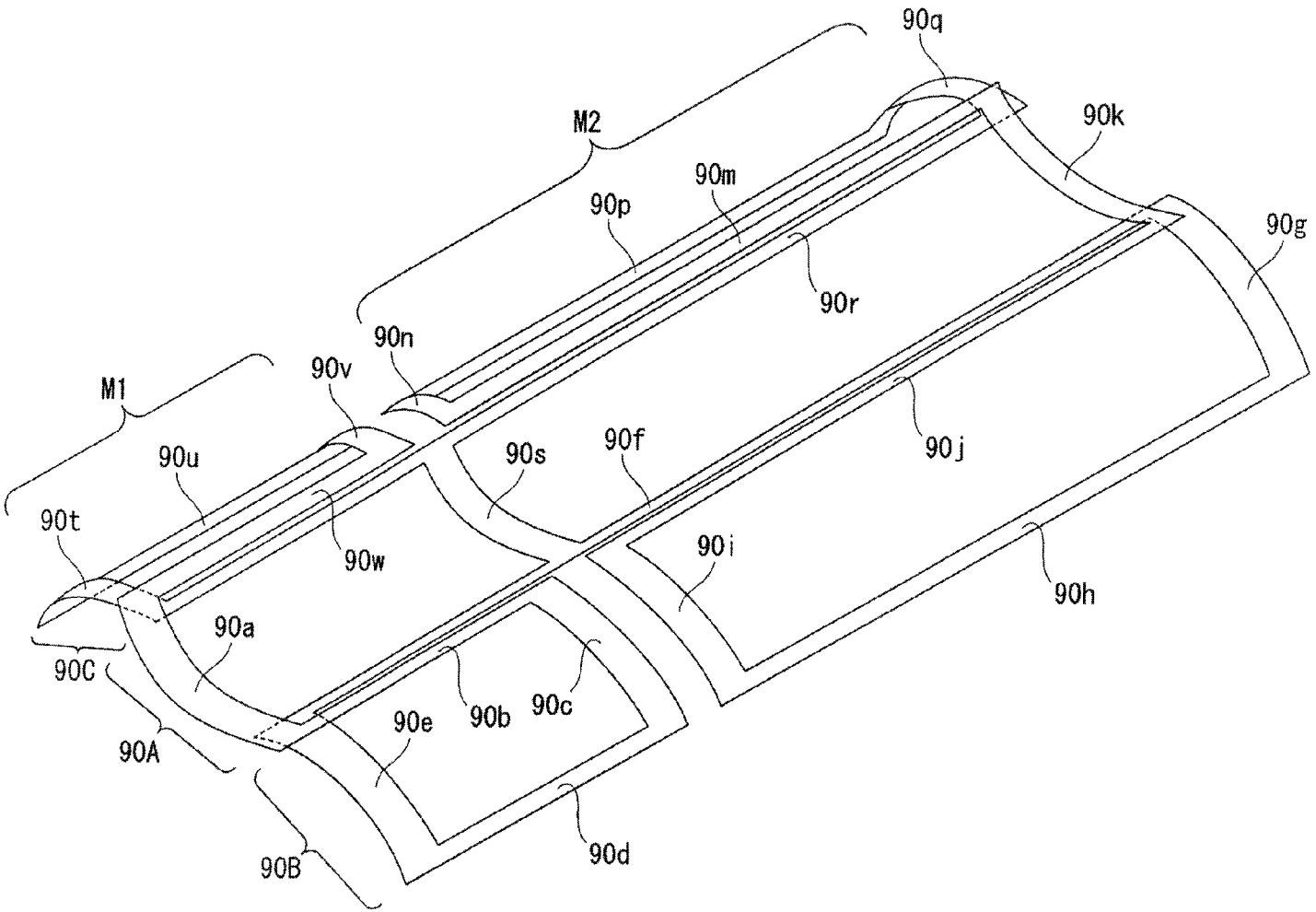
FIG. 4 is a perspective view illustrating a structural example (1) of the magnetism adjustment member.

FIG. 4 is a perspective view illustrating a structural example (1) of the magnetism adjustment member 90. The magnetism adjustment member 90 of the present example mainly has three ring-shaped portions 90A, 90B, 90C, and all these ring-shaped portions 90A, 90B, 90C have an angular ring shape. Further, the three ring-shaped portions 90A, 90B, 90C are linked together, rather than formed as independent rings. As a result, the entire magnetism adjustment member 90 has a continuous endless structure. Each of the ring-shaped portions 90A, 90B, 90C extends along a longitudinal direction of the center core 58. Also, the ring-shaped portions 90A, 90B, 90C are arranged side by side along a circumferential direction of the heat roller 46 or along an arcuate portion of the heating belt 48 on the circumferential surface of the heat roller 46. The structure of the magnetism adjustment member 90 will be explained below.

The magnetism adjustment member 90 has three short-side portions 90*a*, 90*e*, 90*t* in positions at one end and three short-side portions 90*g*, 90*k*, 90*q* in positions at the other end, as viewed in the longitudinal direction thereof. Further, the magnetism adjustment member 90 has two long-side portions 90*d*, 90*h* extending in the longitudinal direction in positions at one side end and two long-side portions 90*p*, 90*u* extending in the longitudinal direction in positions at the other side end, as viewed in the width direction (direction perpendicular to the longitudinal direction).

Further, the magnetism adjustment member 90 has three long-side portions 90*b*, 90*f*, 90*j* extending in the longitudinal direction between the central ring-shaped portion 90A and the ring-shaped portion 90B adjacent thereto in positions shifted from the center thereof in the width direction. The long-side portions 90*b*, 90*f* are arranged side by side along the same straight line and confront the long-side portion 90*j* in the up-down direction. Further, the magnetism adjustment member 90 has three long-side portions 90*m*, 90*r*, 90*w* extending in the longitudinal direction between the central ring-shaped portion 90A and another ring-shaped portion 90C adjacent thereto. The long-side portions 90*m*, 90*w* are arranged side by side along the same straight line and confront the long-side portion 90*r* in the up-down direction.

Furthermore, the magnetism adjustment member 90 has a short-side portion 90*s* that joins the long-side portion 90*f* and long-side portion 90*r* in the width direction within the range of the ring-shaped portion 90A and also has a short-side portion 90*c* that joins the long-side portion 90*b* and long-side portion 90*d* in the width direction and a short-side portion 90*i* that joins the long-side portion 90*j* and long-side portion 90*h* within the range of the ring-shaped portion 90B. The magnetism adjustment member 90 also has a short-side portion 90*v* that joins the long-side portion 90*u* and long-side portion 90*w* in the width direction and a short-side portion 90*n* that joins the long-side portion 90*m* and long-side portion 90*p* within the range of the ring-shaped portion 90C.

[Central Ring-Shaped Portion]

More specifically, the central ring-shaped portion 90A includes three short-side portions 90*a*, 90*k*, 90*s* that form pairs in the longitudinal direction, but these short-side portions 90*a*, 90*k*, 90*s* are not directly connected to each other within the range of the ring-shaped portion 90A. Thus, in the ring-shaped portion 90A, ends of the long-side portions 90*b*, 90*w* are connected to both ends of the short-side portion 90*a*. Among them, the short-side portion 90*c* of the adjacent ring-shaped portion 90B is connected to the other end of the long-side portion 90*b*, and the short-side portion 90*v* of the other adjacent ring-shaped portion 90C is connected to the other end of the long-side portion 90*w*.

Likewise, in the ring-shaped portion 90A, ends of the long-side portions 90*j*, 90*m* are connected to both ends of the short-side portion 90*k*. Among them, the short-side portion 90*i* of the ring-shaped portion 90B is connected to the other end of the long-side portion 90*j*, and the short-side portion 90*n* of the ring-shaped portion 90C is connected to the other end of the long-side portion 90*m*.

In the ring-shaped portion 90A, intermediate portions of the long-side portions 90*f*, 90*r* are connected to both ends of the short-side portion 90*s*. Among them, the short-side portion 90*e* of the ring-shaped portion 90B is connected to one end of the long-side portion 90*f*, and the short-side portion 90*g* of the ring-shaped portion 90B is connected to the other end of the long-side portion 90*f*.

The short-side portion 90*t* of the ring-shaped portion 90C is connected to one end of the long-side portion 90*r*, and the short-side portion 90*q* of the ring-shaped portion 90C is connected to the other end of the long-side portion 90*r*.

Therefore, the short-side portion 90*a* and short-side portion 90*s* that form a pair in the ring-shaped portion 90A are not directly connected to the long-side portions 90*b*, 90*w* that also form a pair within this range. The short-side portion 90*s* and short-side portion 90*k* are also not directly connected to the long-side portions 90*j*, 90*m* that form a pair within the same range.

[Ring-Shaped Portions at Both Sides]

Among the two ring-shaped portions 90B, 90C that are adjacent to the central ring-shaped portion 90A in the width direction thereof, the two short-side portions 90*c*, 90*e* that form a pair in the longitudinal direction are connected to the ring-shaped portion 90B by the long-side portion 90*d* that is shifted to the outside. Among these short-side portions, the short-side portion 90*e* is connected to the short-side portion 90*s* of the central ring-shaped portion 90A by the long-side portion 90*f*, as described hereinabove, and the short-side portion 90*c* is connected to the short-side portion 90*a* by the long-side portion 90*b*, as described hereinabove.

Further, in the ring-shaped portion 90B, the two short-side portions 90*g*, 90*i* that form a pair in the longitudinal direction are connected by the long-side portion 90*h* that is shifted to the outside. Among these short-side portions, the short-side portion 90*g* is connected to the short-side portion 90*s* by the above-described long-side portion 90*f*, and the short-side portion 90*i* is connected to the short-side portion 90*k* of the central ring-shaped portion 90A by the above-described long-side portion 90*j*.

Likewise, concerning the other ring-shaped portion 90C, the two short-side portions 90*t*, 90*v* that form a pair in the longitudinal direction are connected by the long-side portion 90*u* that is shifted to the outside. Among these short-side portions, the short-side portion 90*t* is connected to the short-side portion 90*s* by the above-described long-side portion 90*r*, and the short-side portion 90*v* is connected to the short-side portion 90*a* by the above-described long-side portion 90*w*.

In the ring-shaped portion 90C, the two short-side portions 90*n*, 90*q* that form a pair in the longitudinal direction are connected by the long-side portion 90*p* that is shifted to the outside. Among these short-side portions, the short-side portion 90*n* is connected to the short-side portion 90*k* by the above-described long-side portion 90*m*, and the short-side portion 90*q* is connected to the short-side portion 90*s* by the above-described long-side portion 90*r*.

The short-side portion 90*a* of the ring-shaped portion 90A, the short-side portion 90*e* of the ring-shaped portion 90B, and the short-side portion 90*t* of the ring-shaped portion 90C are disposed in positions corresponding to the maximum sheet passage width (maximum sheet passage area) W3 of sheet that will be described below with reference to FIG. 7, and the short-side portion 90*k* of the ring-shaped portion 90A, the short-side portion 90*g* of the ring-shaped portion 90B, and the short-side portion 90*q* of the ring-shaped portion 90C are disposed outside the minimum sheet passage width (minimum sheet passage area) W1 of sheet.

The short-side portion 90*s* of the ring-shaped portion 90A, the short-side portions 90*c*, 90*i* of the ring-shaped portion 90B, and the short-side portions 90*n*, 90*v* of the ring-shaped portion 90C are disposed on the outside of the intermediate sheet passage width (intermediate sheet passage area) W2 of sheet, that is, between the intermediate sheet passage width W2 and maximum sheet passage width W3. In the magnetism adjustment member 90, a portion demarcated from the short-side portions 90*a*, 90*e*, 90*t* thereof to the short-side portions 90*s*, 90*c*, 90*v* becomes a ring-shaped magnetism adjustment portion M1 (first magnetism adjustment portion) corresponding to a sheet non-passage area with respect to the sheet of intermediate size, and a portion demarcated from the short-side portions 90*s*, 90*i*, 90*n* to the short-side portions 90*k*, 90*g*, 90*q* becomes a ring-shaped magnetism adjustment portion M2 (second magnetism adjustment portion) corresponding to part of the sheet non-passage area with respect to the sheet of the minimum size. Both magnetism adjustment portions M1, M2 correspond to the sheet non-passage areas with respect to the sheet of the minimum size. In other words, the magnetism adjustment portion M1 is disposed outside the intermediate sheet passage width W2, and the magnetism adjustment portion M2 is disposed outside the minimum sheet passage width W1.

[Entire Structure]

Because of the above-described connection relationship, the entire magnetism adjustment member 90 has as a whole an endless structure in which, for example when the short-side portion 90*a* of the central ring-shaped portion 90A is taken as a base point, the long-side portion 90*b*, short-side portion 90*c*, long-side portion 90*d*, short-side portion 90*e*, long-side portion 90*f*, short-side portion 90*g*, long-side portion 90*h*, short-side portion 90*i*, long-side portion 90*j*, short-side portion 90*k*, long-side portion 90*m*, short-side portion 90*n*, long-side portion 90*p*, short-side portion 90*q*, long-side portion 90*r*, short-side portion 90*t*, long-side portion 90*u*, short-side portion 90*v*, long-side portion 90*w*, and short-side portion 90*s* are connected continuously in the order of description from one end thereof.

The short-side portions 90*a*, 90*c*, 90*e*, 90*g*, 90*i*, 90*k*, 90*n*, 90*q*, 90*s*, 90*t*, and 90*v* and the long-side portions 90*b*, 90*d*, 90*f*, 90*h*, 90*j*, 90*m*, 90*p*, 90*r*, 90*u*, and 90*w* are all constituted by a wire material (may be a plate material of a small width) of a nonmagnetic metal, and it is preferred that an insulating coating be provided on the surface portions thereof, in particular on the surface portions that are close to each other.

More specifically, for example, a gap of about 0.5 to 1 mm may be provided between the surface portions that are close to each other and an enamel coating or polyamidoimide coating may be provided. Further, in addition to the coating, a heat-resistant insulating film may be inserted or the surface portions may be covered with a PFA insulating tube or kapton film. This is because of the effect produced by heat generated by the coil 52 and heat radiated from the heating belt 48 or the like.

The three short-side portions 90*a*, 90*k*, 90*s* included in the central ring-shaped portion 90A are formed by curving into a circular arc shape along the outer surface shape of the center core 58, and the short-side portions 90*c*, 90*e*, 90*i*, 90*g*, 90*n*, 90*q*, 90*t*, and 90*v* included in both side ring-shaped portions 90B, 90C are formed by curving into a circular arc shape along the inner peripheral surface shape of the inductive heating coil 52. As a result, in a state in which the magnetism adjustment member 90 is attached, the interference with the center core 58 of inductive heating coil 52 can be avoided.

[Functions of Magnetism Adjustment Member]

Figure 5A:
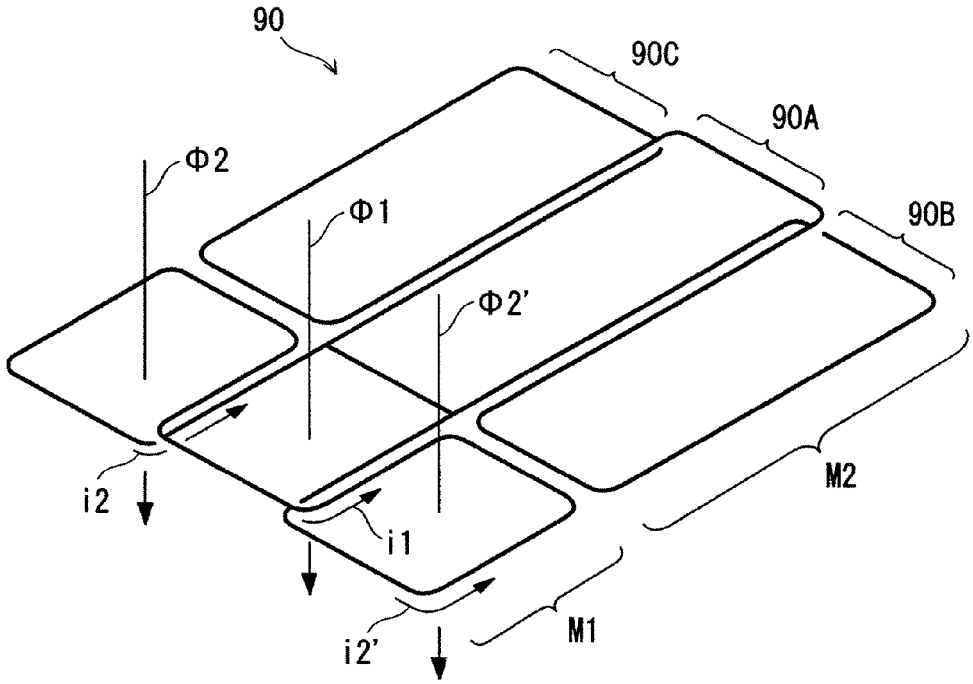
FIG. 5A is a model diagram explaining the functions of the magnetism adjustment member.
Figure 5B:
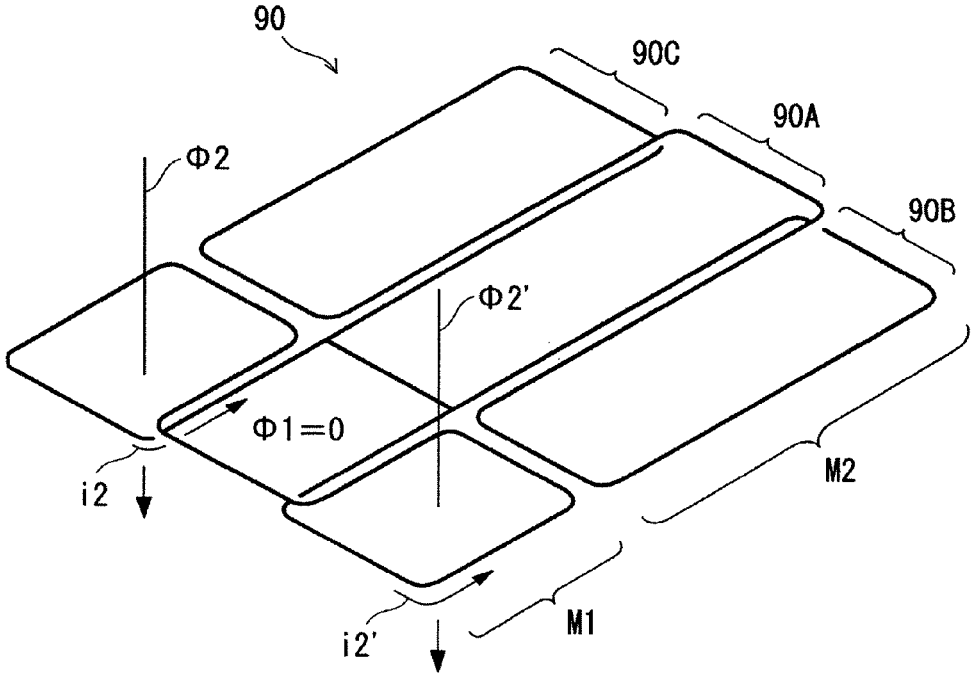
FIG. 5B is a model diagram explaining the functions of the magnetism adjustment member.

FIG. 5A and FIG. 5B are model drawings serving to explain the functions of the magnetism adjustment member 90. In FIG. 5A and FIG. 5B, the magnetism adjustment member 90 is shown in a simplified way as a wire model, but the connection relationship of the ring-shaped portions 90A, 90B, 90C is identical to that shown in FIG. 4. In FIGS. 5A and 5B, for the sake of convenience, the short-side portions 90*a*, 90*c*, 90*e*, 90*g*, 90*i*, 90*k*, 90*n*, 90*q*, 90*s*, 90*t*, and 90*v* are shown as linear portions.

[During Passing of the Magnetic Flux]

Where the magnetism adjustment member 90 is considered as a wire model, as shown in FIG. 5A, the structure thereof can be assumed to be obtained by twisting one large ring (annular body) in a plurality of locations in the mutually different directions, forming the three ring-shaped portions 90A, 90B, 90C as described hereinabove, and forming the magnetism adjustment portions M1, M2 in the longitudinal direction thereof. Also, the ring-shaped portions 90A, 90B, 90C are arranged side by side in a direction intersecting with a traveling direction of magnetic flux which penetrates the ring-shaped portions 90A, 90B, 90C.

Where a magnetic flux Φ1 enters the inside of the central ring-shaped portion 90A, for example, in the magnetism adjustment portion M1 of the magnetism adjustment member 90, an electric current i1 (induction current that generates a cancel magnetic flux in the direction opposite that of the magnetic flux Φ1) aimed to eliminate this magnetic flux is generated in the ring-shaped portion 90A. Likewise, where magnetic fluxes Φ2, Φ2' enter the inside of the two ring-shaped portions 90B, 90C that are adjacent at both sides (left and right sides), electric currents i2, i2' (induction currents that generate the cancel magnetic fluxes in the directions opposite those of the magnetic fluxes Φ2, ΦI2') are generated in the ring-shaped portions 90B, 90C.

In this case, the direction of electric currents i2, i2' generated in the ring-shaped portions 90B, 90C at both sides is the same, but the electric current i1 generated in the central ring-shaped portion 90A flows in the opposite direction. Therefore, the electric current (total) flowing inside the magnetism adjustment member 90 when the below-described Conditional Equation (1) is satisfied becomes zero.

$$|i1|=|i2|+|i2'| \quad (1)$$

Here, |i1|, |i2|, and |i2'| represent absolute values of respective electric currents (magnetomotive force).

Therefore, when Conditional Equation (1) is satisfied, all the magnetic fluxes Φ1, Φ2, Φ2' can pass through inside the ring-shaped portions 90A, 90B, 90C, without being canceled.

[During Shielding of the Magnetic Flux]

A case is assumed where only the magnetic flux Φ1 entering the central ring-shaped portion 90A is deleted from the above-described state (Φ1=0), as shown in FIG. 5B. In this case, no electric current is generated in the central ring-shaped portion 90A (i1=0), and the electric current flowing inside the magnetism adjustment member 90 becomes equal to the right side (|i2|+|i2'|) of Conditional Equation (1).

Therefore, when the magnetic flux Φ1 of the central ring-shaped portion 90A is deleted, the magnetic fluxes Φ2, Φ2' are canceled by the electric currents i2, i2' in the ring-shaped portions 90B, 90C at both sides. As a result, the magnetic fluxes Φ2, Φ2' are shielded by the ring-shaped portions 90B, 90C.

From the above, the following conclusions (1) and (2) have been reached with respect to the magnetism adjustment member 90.

(1) When the relationship $\Phi 1=\Phi 2+\Phi 2'$ is satisfied, the electric current generated inside the magnetism adjustment member 90 becomes zero, and the magnetism adjustment member 90 allows all the magnetic fluxes $\Phi 1$, $\Phi 2$, $\Phi 2'$ to pass. In this case, the presence of the magnetism adjustment member 90 produces no effect on magnetic field.

(2) Where $\Phi 1$ is taken to be equal to zero from the state described in clause (1) above, an electric current i2+i2' flows inside the magnetism adjustment member 90. Therefore, the magnetism adjustment member 90 shields the magnetic fluxes $\Phi 2$, $\Phi 2'$ and does not allow them to pass. In this case, the magnetism adjustment member 90 demonstrates a magnetic shielding effect within the range of the ring-shaped portions 90B, 90C.

In view of the conclusions (1) and (2), the fixing unit of the first embodiment has a structure and arrangement of components such that the following relational expression (2) is satisfied with respect to the magnetic flux $\Phi 1$ (Wb) entering the central ring-shaped portion 90A of the magnetism adjustment member 90 and the magnetic fluxes $\Phi 2$, $\Phi 2'$ (Wb) entering the two ring-shaped portions 90B, 90C adjacent to both sides thereof.

$$\Phi 1=\Phi 2+\Phi 2' \quad (2)$$

Figure 6A:
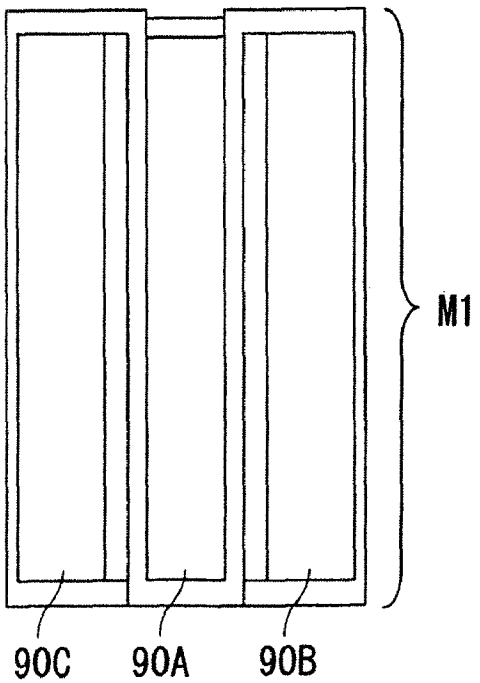
FIGS. 6A to 6C are plan views illustrating the structural example (1) or (2).

In the structural example (1) that has the above-described magnetism adjustment portions M1, M2, the two configurations shown in FIG. 6A are not simply linked. Thus, where the two configurations shown in FIG. 6A are arranged in the longitudinal direction and the adjacent portions are connected by one wire and made common, three closed ring-shaped portions appear because of such common configuration, the electric current i flows only inside each ring-shaped portion and the electric current (total) of the magnetism adjustment member 90 cannot be made zero. In other words, three closed circuits appear, no electric current flows in the connection portions, the ring-shaped portions are in a shielded state at all times, and magnetic flux adjustment is not performed.

In this case it is necessary to cut the closed circuits in order to cause all the three ring-shaped portions to function effectively. This is done by connecting a ring-shaped portion with a ring-shaped portion by two wires, linking with two wires is made in two locations, and linking with one wire is made in one location.

In the case of the above-described structural example (1), the ring-shaped portion 90A and ring-shaped portion 90B are linked by two short-side portions 90*c*, 90*i*, and the ring-shaped portion 90A and ring-shaped portion 90C are linked by two short-side portions 90*n*, 90*v*. The ring-shaped portion 90B and ring-shaped portion 90C are linked by one short-side portion 90*s* (FIG. 5A and FIG. 5B).

Figure 6B:
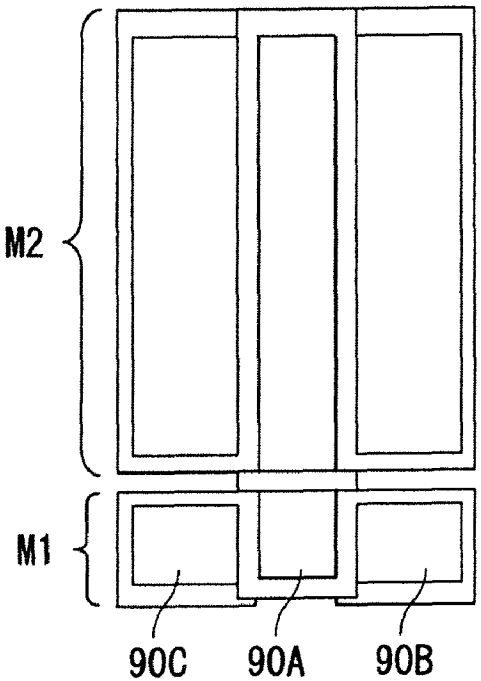

As a result, the structural example (1) is formed as shown in FIG. 6B and becomes a magnetism adjustment member 90 that has two magnetism adjustment portions M1, M2 and has no space serving as ineffective portion between the magnetism adjustment portion M1 and magnetism adjustment portion M2. Where the range of the central ring-shaped portion 90A that confronts the center core 58 is linked by one wire, the degree of freedom in designing the IH coil unit 50 can be increased.

Figure 6C:
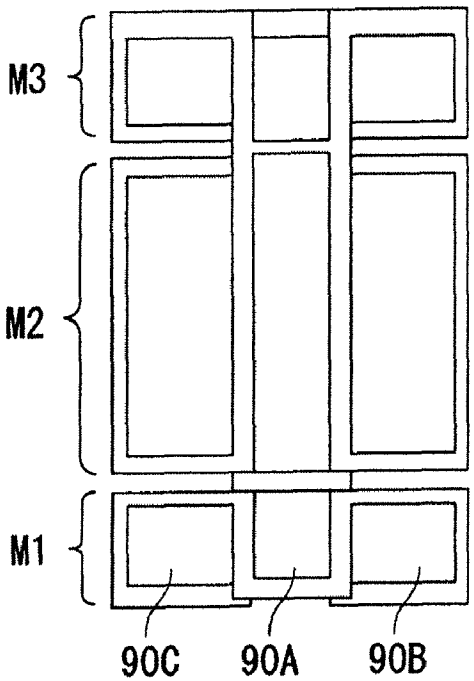

The above-described method can be used even when the corresponding dimensions are increased with respect to those of the structural example (1). More specifically, a structural example (2) is shown in FIG. 6C. In this case, a magnetism adjustment portion M3 (third magnetism adjustment portion) is disposed on the side opposite that of the magnetism adjustment portion M1 so that the magnetism adjustment portion M2 is disposed therebetween. More specifically, the magnetism adjustment portion M3 is disposed over the boundary section of the minimum sheet passage width W1 and intermediate sheet passage width W2. Thus, a total of three magnetism adjustment portions M1, M2, M3 are formed in the longitudinal direction of the center core 58.

The magnetism adjustment portion M3 corresponds to part of the sheet non-passage area with respect to the sheet of intermediate small size. Thus, the magnetism adjustment portion can be increased to any degree by a similar method.

Figure 7A:
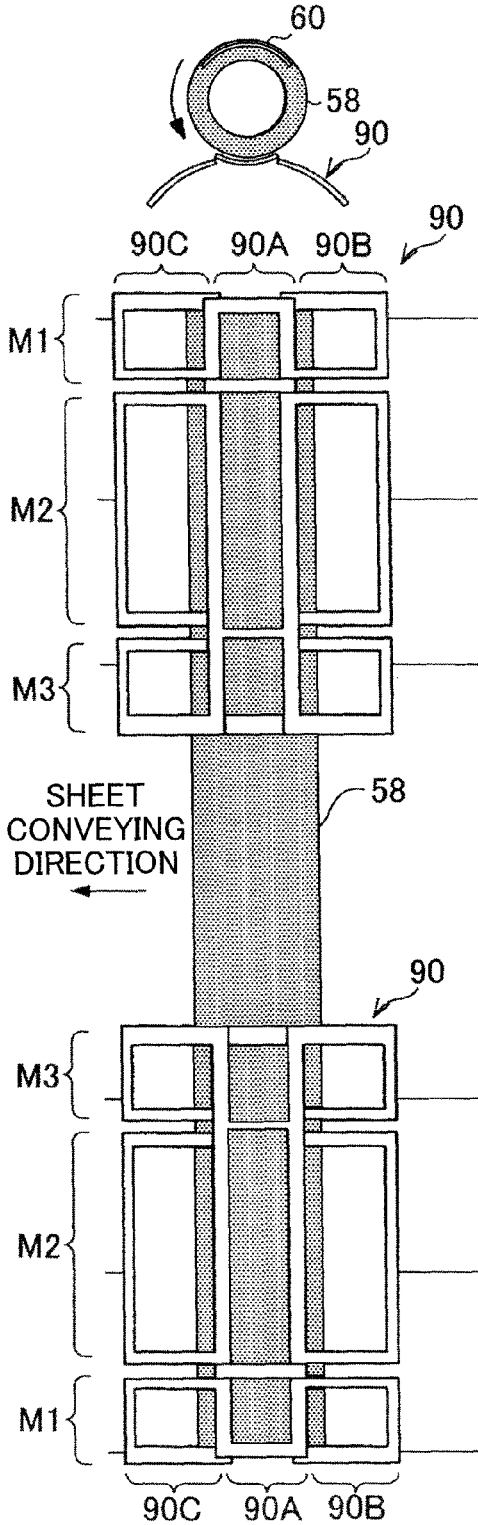
FIG. 7A illustrates the arrangement of the structural example (2).
Figure 7B:
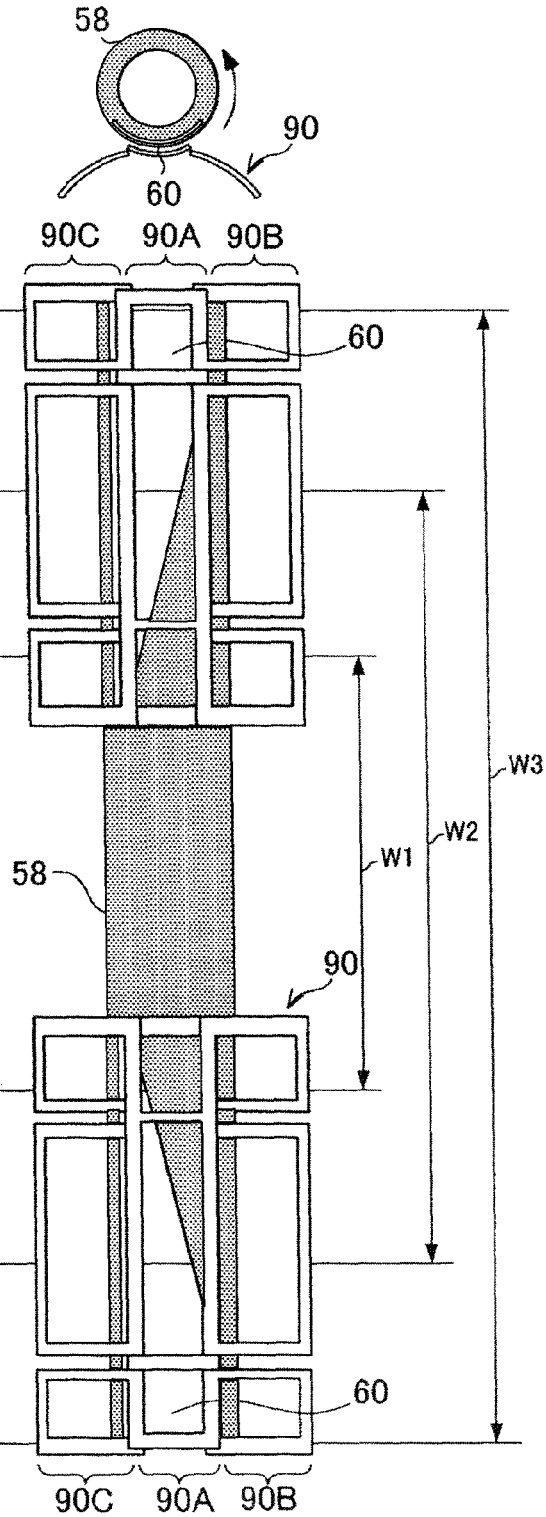
FIG. 7B illustrates the arrangement of the structural example (2).

FIG. 7A and FIG. 7B illustrate the arrangement of the magnetism adjustment member 90 in the structural example (2) shown in FIG. 6C. FIG. 7A and FIG. 7B are respectively a side view of the center core 58 and magnetism adjustment member 90 and the bottom view thereof. In the figure, the outer surface of the center core 58 is half-toned.

As shown in FIG. 7A, where the sheet size is the largest, the fixing unit 14 withdraws the shielding member 60 to the outside of the magnetic path (retracted position), following the rotation of the center core 58. By so retracting the shielding member 60, it is possible to cause the magnetic fluxes $\Phi 1$, $\Phi 2$, $\Phi 2'$ that satisfy the aforementioned Conditional Equation (2) to pass through the magnetism adjustment portions M1, M2, M3. In this case, the above-described heat roller 46 is inductively heated over the entire area of the maximum sheet passage width W3 of the sheet.

As shown in FIG. 7B, when the sheet size is less than the maximum sheet passage width W3, the fixing unit 14 advances the shielding member 60 into the magnetic path (shielding position), following the rotation of the center core 58. By so placing the shielding member 60 into the shielding position, it is possible to shield the magnetic flux directed towards the heat roller 46 from the center core 58 at both sides, demonstrate a magnetic flux shielding effect of a total of two magnetism adjustment portions M1 at both sides, and obtain a state in which the magnetic flux $\Phi 1$ is equal to zero. As a result, an excessive increase in temperature in both end portions of the heat roller 46 outside the intermediate sheet passage width W2 is prevented.

The shielding member 60 is divided in two in the longitudinal direction of the center core 58, and the two members form together a symmetrical configuration. Each shielding member 60 extends from the magnetism adjustment portion M1 along the magnetism adjustment portion M3, as viewed in the longitudinal direction of the center core 58. Further, each shielding member 60 has a right-angled triangle shape for example in the plan or bottom view thereof, and a portion corresponding to the apex of the triangle is positioned close to the center of the center core 58. In other words, the length of the shielding member 60 viewed in the circumferential direction thereof is the shortest in the position close to the center of the center core 58, and the length of the shielding member 60 in the circumferential direction expands gradually towards both side ends of the center core 58.

In the state shown in FIG. 7B, the major portion of the shielding member 60 is provided at both outer sides of the minimum sheet passage width W1 that is perpendicular to the sheet conveying direction, and only a small portion is provided in the range of the minimum sheet passage width W1. Further, the shielding member 60 reaches a location slightly outside the maximum sheet passage width W3 of the sheet at both ends of the center core 58. The minimum sheet passage width W1 and maximum sheet passage width W3 are determined by the sheet of minimum size or maximum size that can be printed in the image forming apparatus 1.

Where the center core 58 is further rotated counterclockwise from the state shown in FIG. 7B, the shielding member 60 can shield (Φ1=0) the magnetic flux entering the central ring-shaped portion 90A in the total of four magnetism adjustment portions M1, M2 on both sides. Where the center core 58 is further rotated counterclockwise, the magnetic flux entering the central ring-shaped portion 90A can be also shielded (Φ1=0) in the total of six magnetism adjustment portions M1, M2, M3 at both sides and the desirable magnetic flux shielding effect can be demonstrated with respect to each sheet passage width W1, W2, W3.

In the first embodiment, the ratio of the length of the shielding member 60 to the outer circumferential length of the center core 58, as viewed in the rotation direction of the center core, differs in the axial direction (longitudinal direction) of the center core 58. In this case, where the ratio of the length (Lc) of the shielding member 60 to the outer circumferential length (L) of the center core 58 is taken as a coverage ratio (=Lc/L), the coverage ratio is small on the inside of the center core 58 and increases therefrom towards the outside (both ends) of the center core in the axial direction. More specifically, the coverage ratio is minimal in the vicinity of the minimum sheet passage area (range of the minimum sheet passage width W1) and, conversely, maximal at both ends of the center core 58. In other words, the coverage ratio decreases from the magnetism adjustment portion M1 towards the magnetism adjustment portion M3, as viewed in the longitudinal direction of the center core 58.

As described hereinabove, the change in the sheet size (sheet passage width) is dealt with by moving the shielding member 60 to the retracted position and shielding position and switching the magnetic path in these positions, thereby partially inhibiting the generated magnetic flux (making Φ1=0). In this case, both end portions of the heat roller 46 and the heating belt 48 can be prevented from an excessive increase in temperature by varying the rotation angle (rotation displacement amount) of the center core 58 according to the sheet size (sheet passage width), decreasing the magnetic shielding quantity with the increase in sheet size and, conversely, increasing the shielding quantity with the decrease in sheet size. In FIG. 7A and FIG. 7B, the rotation in the counterclockwise direction is shown by an arrow, but the center core 58 may also rotate in the clockwise direction. The sheet conveying direction may be also opposite to that shown in FIG. 7A and FIG. 7B.

Operation Example

Figure 9B:
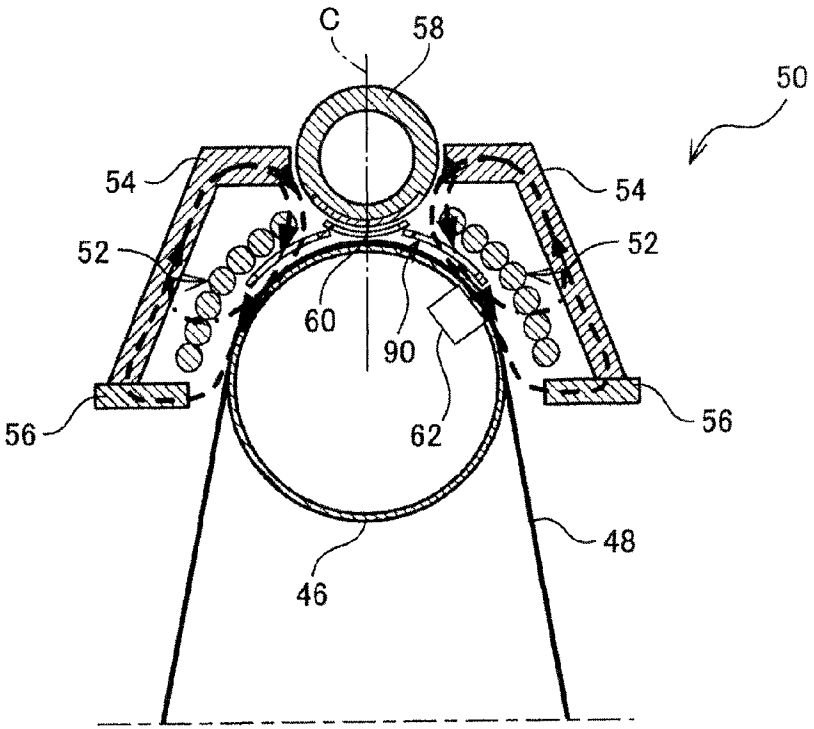
FIG. 9B illustrates an operation example using the structural example (1) or (2).
Figure 9A:
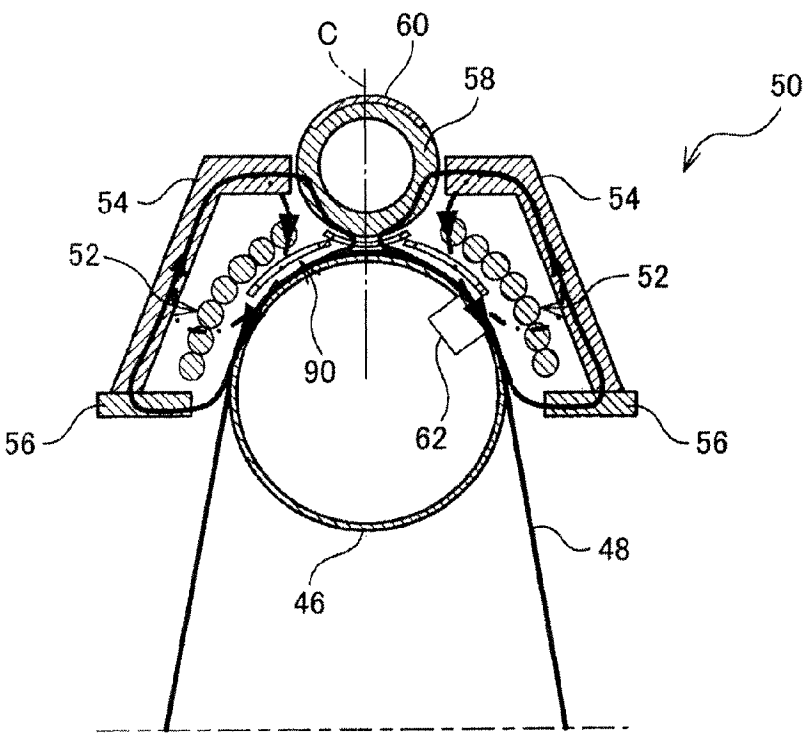
FIG. 9A illustrates an operation example using the structural example (1) or (2).

FIG. 9A and FIG. 9B show examples of operations performed following the rotation of the center core 58 in the above-described structural examples (1) and (2). These operations will be explained below.

[First Path]

As shown in FIG. 9A, when the shielding member 60 is moved to the retracted position, following the rotation of the center core 58, the magnetic path (first path), within the range of the magnetic field generated by the inductive heating coil 52, passes via the side core 56, arch core 54, and center core 58, passes through the winding center C of the inductive heating coil 52 or vicinity thereof, and reaches the heating belt 48 and heat roller 46. In this case, an eddy current is generated in the heating belt 48 and heat roller 46 that are ferromagnetic materials, Joule heat is generated due to a specific resistance of these materials, and heating is performed. Further, in this case, the aforementioned magnetic flux Φ1 passes through inside the central ring-shaped portion 90A of the magnetism adjustment member 90.

Further, on the inside of the magnetic path that passes via the side core 56, arch core 54, and center core 58 and through the heating belt 48 and heat roller 46, a short-cut magnetic flux (a thick dash-dot line in the figure) that tends to leak, for example, from the arch cores 54 is generated and passes through the ring-shaped portions 90B, 90C on both sides of the magnetism adjustment member 90. In this case, the aforementioned magnetic fluxes Φ2, Φ2' are assumed to pass through inside the ring-shaped portions 90B, 90C. Therefore, not only the magnetic flux Φ1 that passes through the main first path, but also other leakage magnetic fluxes Φ2, Φ2 can be also caused to contribute to heat generation and the heat generation efficiency during full-width heating can be accordingly increased.

[Second Path]

As shown in FIG. 9B, when the shielding member 60 is then moved to the shielding position, because the shielding member 60 is positioned on the magnetic path outside the minimum sheet passage area, the magnetic path outside the minimum sheet passage area is switched, within the range of the magnetic field generated by the inductive heating coil 52, to a second path (thick broken line in the figure) that exits from the end surface of the arch core 54 and reaches the heating belt 48 and the heat roller 46, without passing through the center core 58. As a result, the amount of heat generation outside the minimum sheet passage area is reduced and the heating belt 48 and heat roller 46 can be prevented from an excessive increase in temperature. As described above, the switching of the magnetic path between the first path and the second path in the range of the magnetic field generated by the induction coil 52 makes it possible to avoid the excessive temperature increase in the heating belt 48 and the heat roller 46.

[Functions of Magnetism Adjustment Member]

After switching the magnetic path to the second path, a state is assumed in which the magnetic flux passing inside the central ring-shaped portion 90A of the magnetism adjustment member 90 is zero (magnetic flux Φ1=0). In this case, a weak magnetic flux (a broken line somewhat surrounding the inside of the arch core 54) that tends to leak from the arch cores 54 is also generated in the second path, but the magnetism adjustment member 90 can demonstrate a shielding effect with respect to all the magnetic fluxes Φ2, Φ2' that pass through the second path as described hereinabove. Therefore, the fixing unit 14 of the first embodiment can demonstrate a sufficient magnetic shielding effect in the sheet non-passage area, without excessive enlargement of the surface area of the shielding member 60. As a result, an excessive increase in temperature of the heating belt 48 and heat roller 46 can be inhibited more effectively than in the conventional configurations.

Fixing units 14 of the second to ninth embodiments that are based on the above-described fixing unit 14 of the first embodiment can be also considered. These embodiments will be explained below. The components that are common with the first embodiment will be assigned with same reference numeral in the description and also in the figures and the redundant explanation thereof will be omitted. In particular, when materials are different, even if the reference numerals are the same, this difference will be additionally explained.

Second Embodiment

Figure 10:
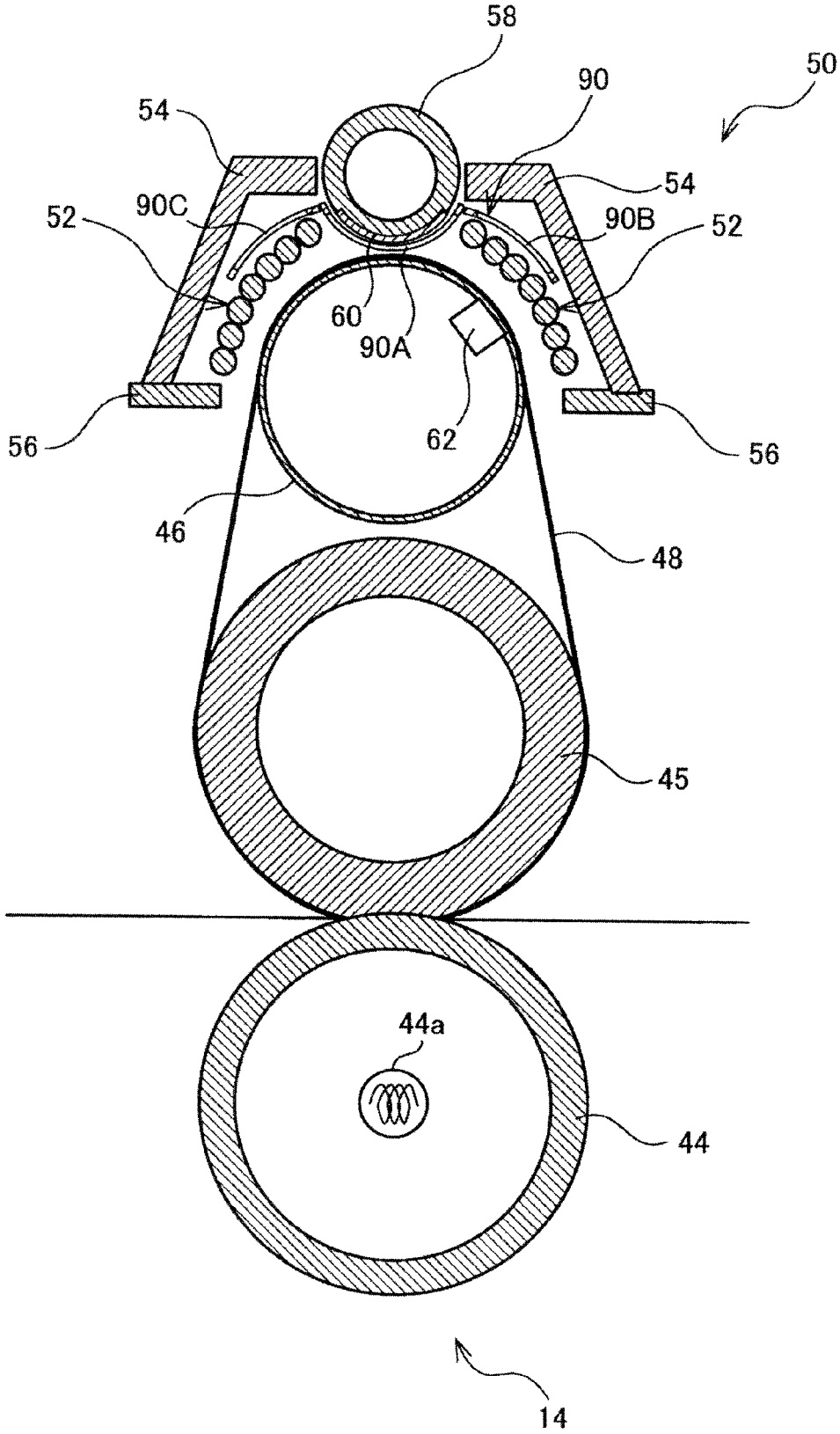
FIG. 10 is a vertical sectional view illustrating the second embodiment of the fixing unit.

FIG. 10 is a vertical sectional view illustrating a structural example of the fixing unit 14 of the second embodiment. The second embodiment differs from the first embodiment in the arrangement and form of the magnetism adjustment member 90. More specifically, in the magnetism adjustment member 90, the central ring-shaped portion 90A is disposed between the center core 58 and heating belt 48, but the ring-shaped portions 90B, 90C at both sides are disposed outside the inductive heating coil 52, that is, between the arch core 54 and inductive heating coil 52.

In this example, if the Conditional Equation (1) is satisfied after switching the magnetic path to the first path (a state in which the shielding member 60 is placed in the retracted position), as described hereinabove, the magnetism adjustment member 90 also can cause the magnetic flux to pass effectively in the same manner as in the first embodiment. Further, where the magnetic flux Φ1 passing through the central ring-shaped portion 90A can be made zero after switching the magnetic path to the second path (a state in which the shielding member 60 is placed in the shielding position), the magnetism adjustment member 90 as a whole can demonstrate the magnetic flux shielding effect.

Third Embodiment

Figure 11:
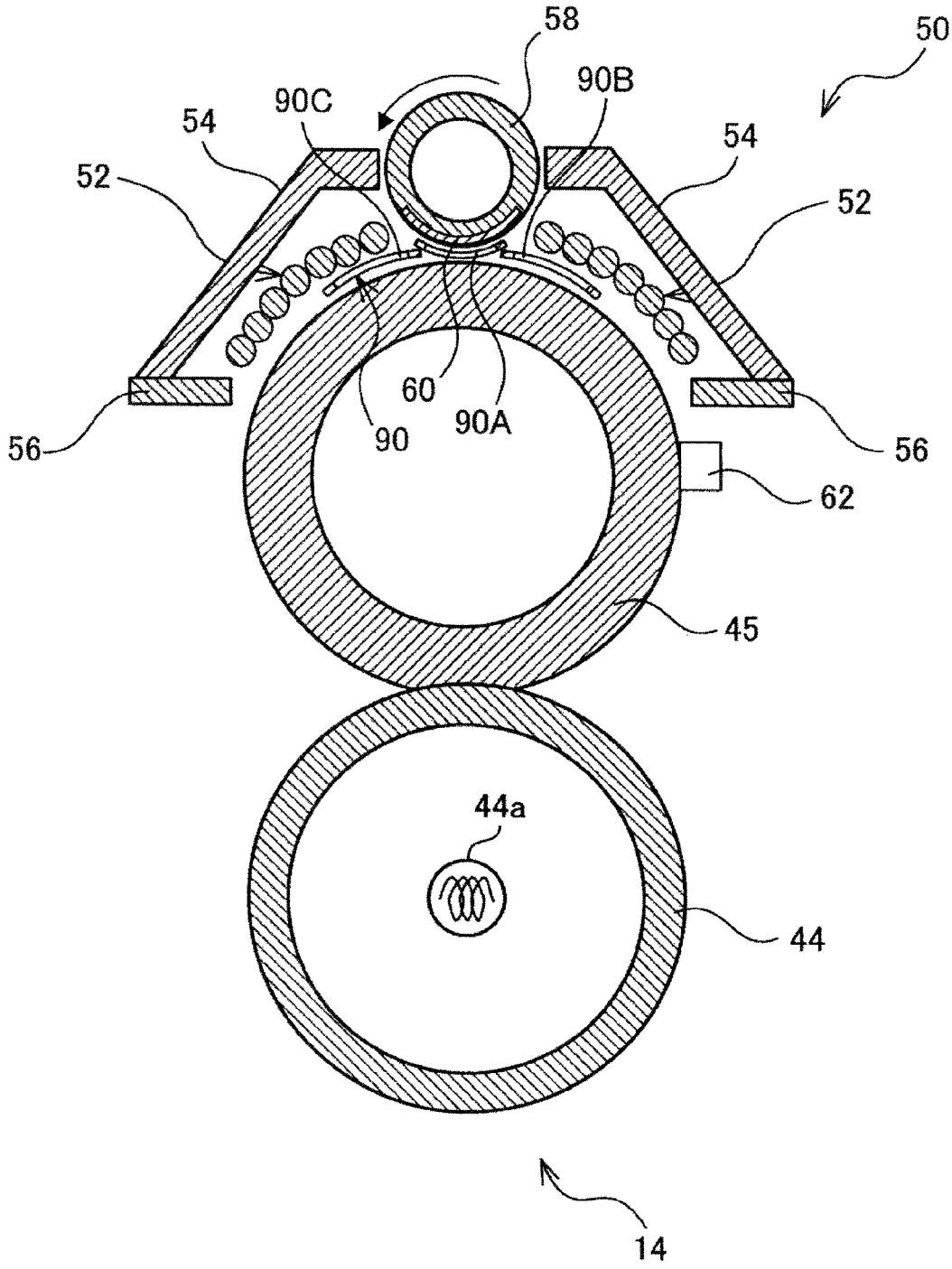
FIG. 11 is a vertical sectional view illustrating the third embodiment of the fixing unit.

FIG. 11 is a vertical sectional view illustrating a structural example of the fixing unit 14 of the third embodiment. In the third embodiment, a toner image is fixed by the fixing roller 45 and the pressing roller 44, without using the above-described heating belt. In this configuration, for example, a magnetic body similar to the heating belt is wound on the outer circumference of the fixing roller 45, and the magnetic body is inductively heated by the inductive heating coil 52. In this case, the thermistor 62 is provided in a position facing the magnetic body layer on the outside of the fixing roller 45.

The magnetism adjustment member 90 can be also used as shown in the figure in the fixing unit 14 of the third embodiment.

Fourth Embodiment

Figure 12:
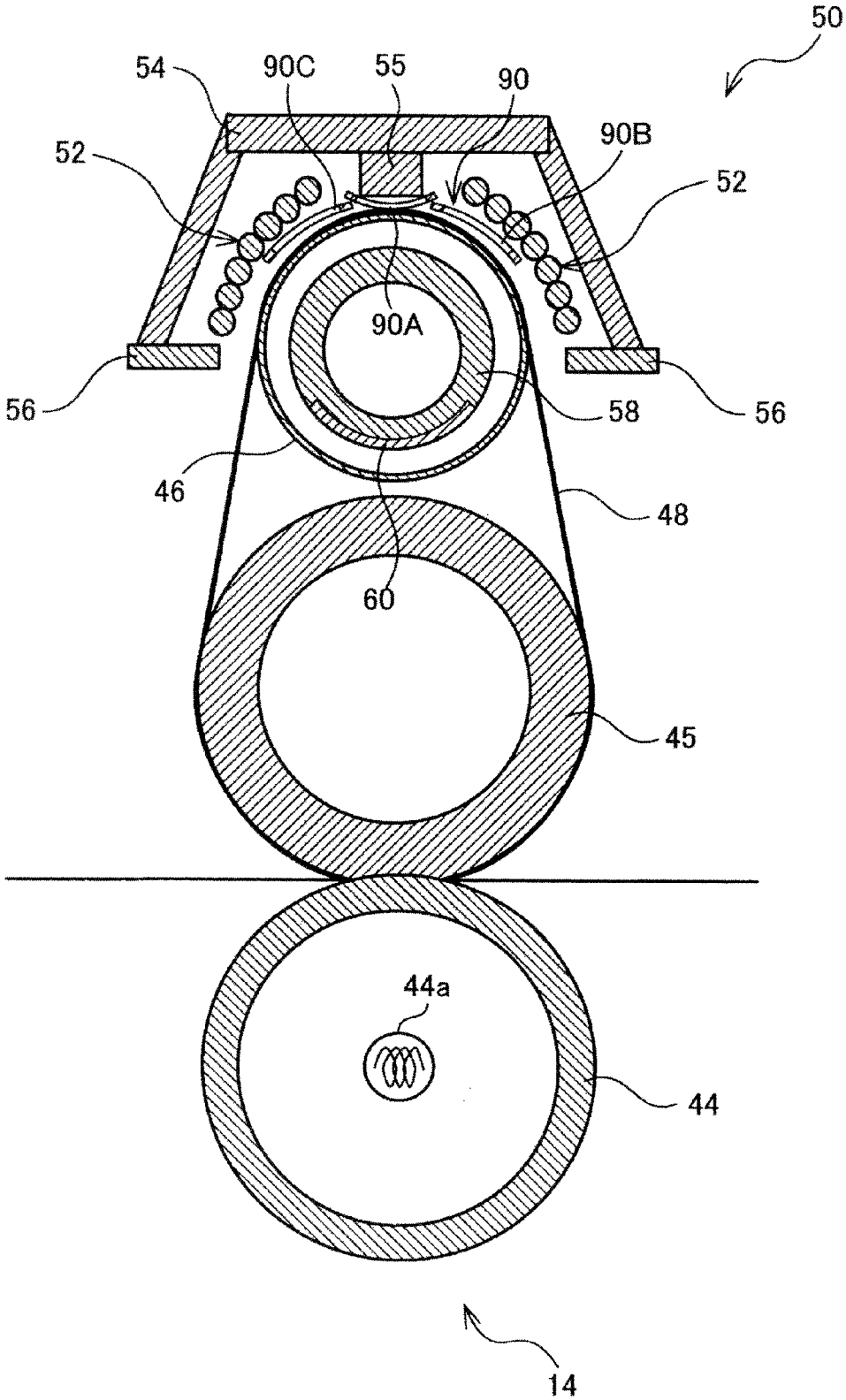
FIG. 12 is a vertical sectional view illustrating the fourth embodiment of the fixing unit.

FIG. 12 is a vertical sectional view illustrating a structural example of the fixing unit 14 of the fourth embodiment. The fourth embodiment differs from the first embodiment in that the heat roller 46 is constituted by a nonmagnetic metal (for example, SUS: stainless steel) material and the center core 58 is disposed inside the heat roller 46. Further, the arch cores 54 are all connected in the center, and the intermediate core 55 is disposed below it.

When the heat roller 46 is from a nonmagnetic metal, the magnetic field generated by the inductive heating coil 52 passes through the side cores 56, arch cores 54, and intermediate core 55 and reaches the internal center core 58 via the heat roller 46. The heating belt 48 is inductively heated by the passing magnetic field. Further, in the fourth embodiment, where the shielding member 60 is withdrawn from the intermediate core 55 as shown in FIG. 12, switching the magnetic path to the first path is performed (retracted position). In this case, the shielding member 60 does not produce the magnetic shielding effect and the heating belt 48 is inductively heated in the maximum sheet passage area. Where the shielding member 60 is moved to a position facing the intermediate core 55 (shielding position), the magnetic path is switched to the second path and an excessive increase in temperature outside the sheet passage area is inhibited.

In the fixing unit 14 of the fourth embodiment, the function identical to that of the first embodiment can be also demonstrated by disposing the magnetism adjustment member 90, for example, between the intermediate core 55 and heating belt and also between the inductive heating coil 52 and heating belt 48.

Fifth Embodiment

Figure 13:
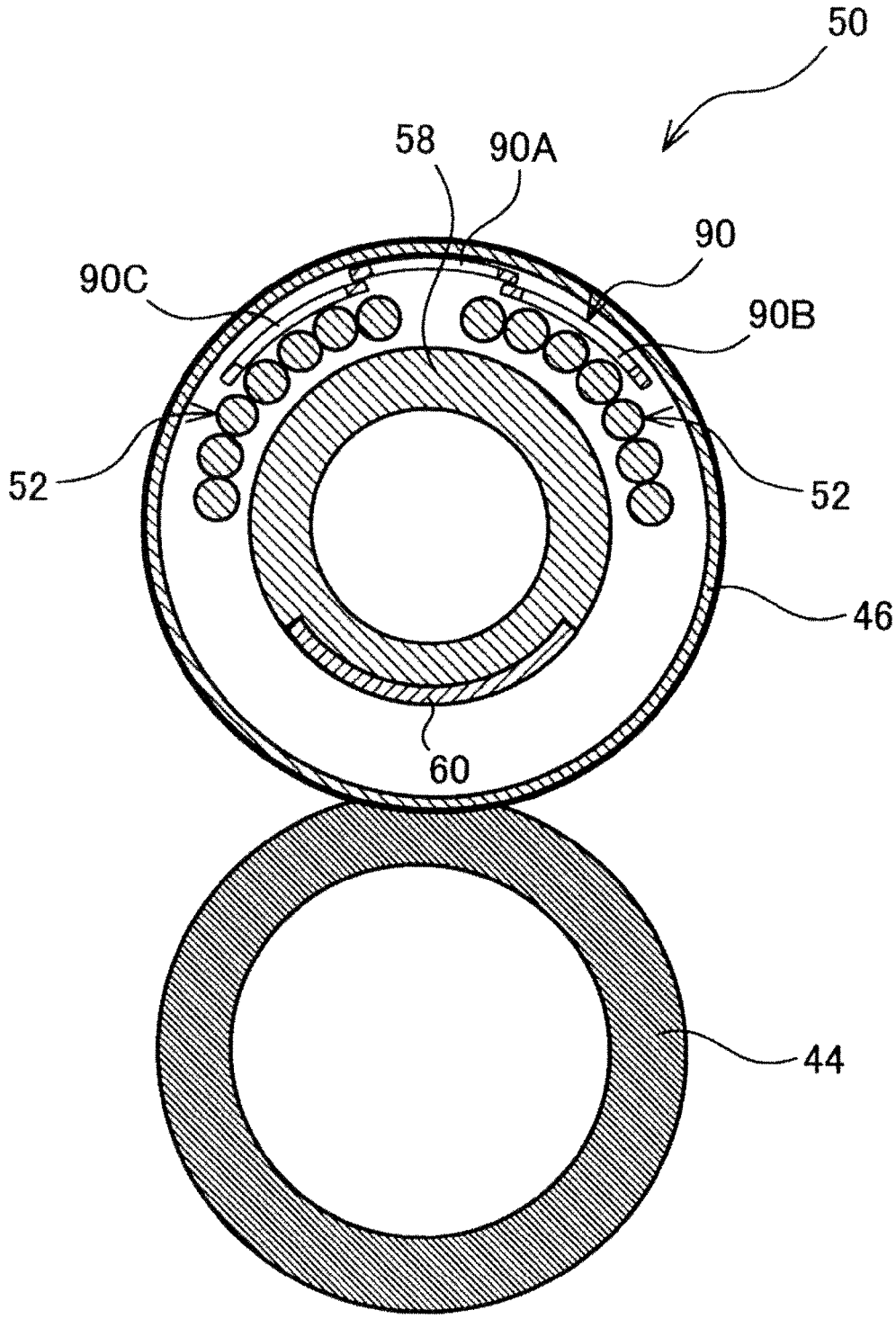
FIG. 13 is a vertical sectional view illustrating the fifth embodiment of the fixing unit.

FIG. 13 is a vertical sectional view illustrating a structural example of the fixing unit 14 of the fifth embodiment. In the fifth embodiment, the IH coil unit 50 is of the so-called enclosed IH type. More specifically, the heat roller 46 is constituted by a nonmagnetic metal (for example, SUS) of a comparatively large diameter (for example 40 mm), and the inductive heating coil 52 and center core 58 are accommodated inside thereof. An arch core 54 and side core 56 such as described in the first to fourth embodiments are not provided outside the heat roller 46. A mold releasing layer (PFA) is formed on the surface of the heat roller 46. The pressing roller 44 is identical to that of the first to third embodiments.

In the enclosed IH such as that of the fifth embodiment, the magnetic field generated by the inductive heating coil 52 is guided by the center core 58 inside the heat roller 46 and inductively heats the heat roller 46. In the fifth embodiment, where the shielding member 60 is retracted from the inductive heating coil 52, a state is assumed in which the magnetic path is switched to the first path (retracted position), as shown in FIG. 13. In this case, no magnetic shielding effect is produced and the heating belt 48 is inductively heated in the maximum sheet passage area. Where the shielding member 60 is moved to a position (shielding position) close to the inductive heating coil 52, the magnetic path is switched to the second path and an excessive increase in temperature outside the sheet passage area is inhibited.

In the fixing unit 14 of the fifth embodiment, the magnetism adjustment member 90 can be also fixedly disposed between the inner circumferential surface of the heat roller 46 and the inductive heating coil 52, for example, as shown in the figure.

Sixth Embodiment

Figure 14:
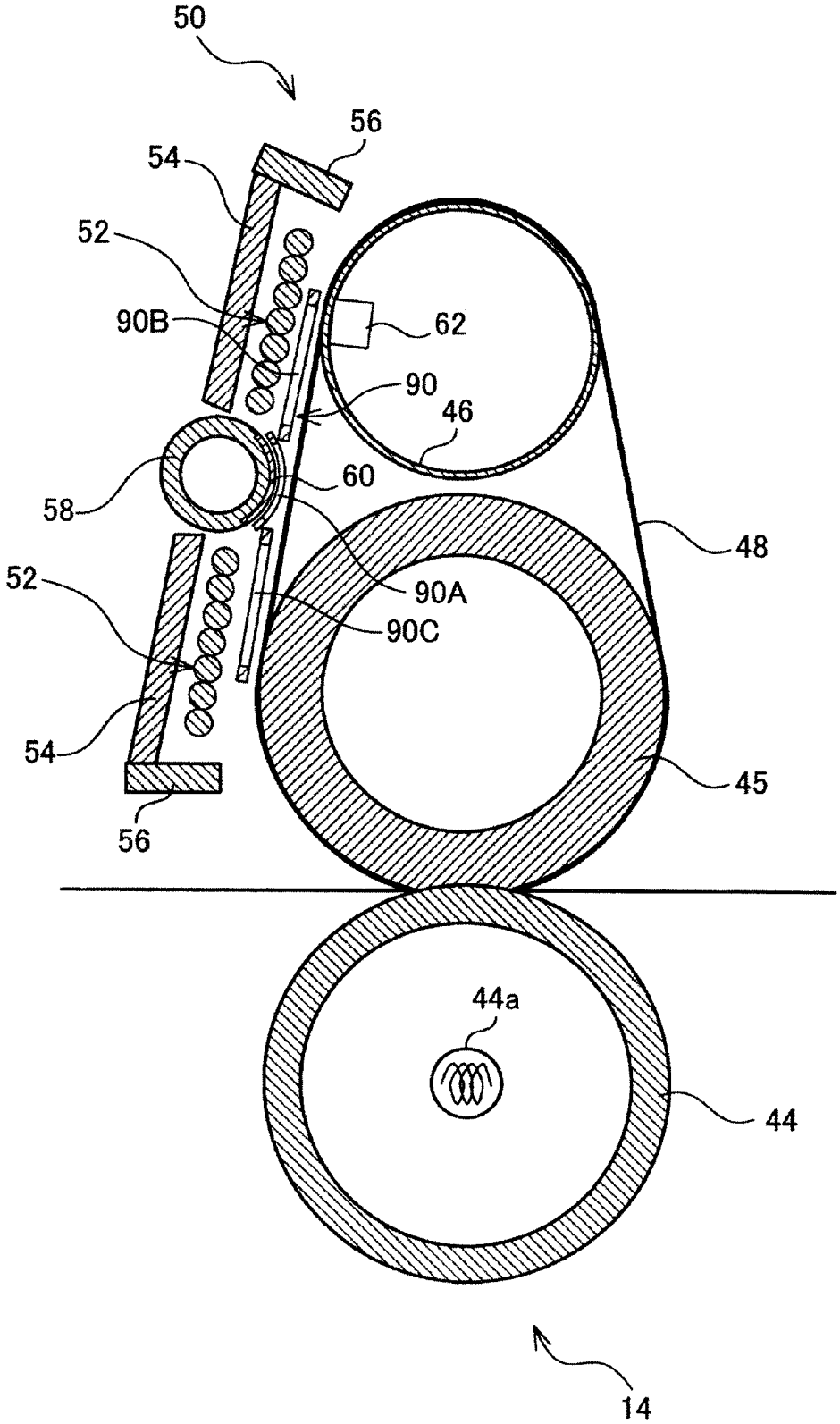
FIG. 14 is a vertical sectional view illustrating the sixth embodiment of the fixing unit.

FIG. 14 is a vertical sectional view illustrating a structural example of the fixing unit 14 of the sixth embodiment. In the configuration of the sixth embodiment, inductive heating is conducted in a flat position between the heat roller 46 and fixing roller 45, rather than in the circular arc position of the heating belt 48. In this case, the magnetic path can be similarly switched by rotating the center core 58. When the magnetic path is switched to the first path, the magnetism adjustment member 90 allows the magnetic flux to pass therethrough effectively, and when the magnetic path is switched to the second path, the magnetism adjustment member 90 shows the magnetic flux shielding effect.

Further, in the magnetism adjustment member 90, only the central ring-shaped portion 90A has a curved shape, and the ring-shaped portions 90B, 90C at both sides are not curved and have a flat shaped. Such a magnetism adjustment member 90 is fixedly disposed, for example, between the inductive heating coil 52 and heating belt 48.

Seventh Embodiment

Figure 15:
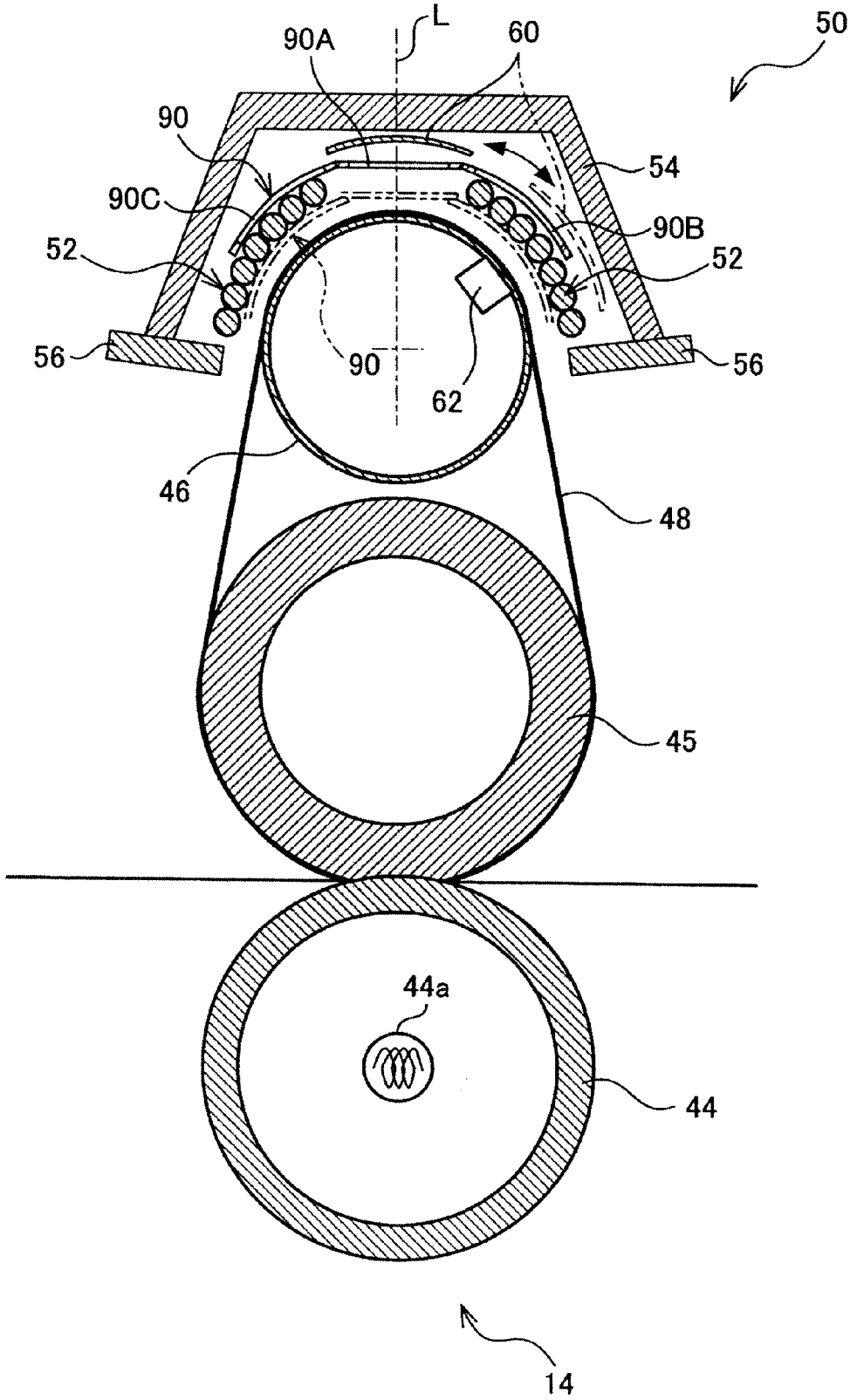
FIG. 15 is a vertical sectional view illustrating the seventh embodiment of the fixing unit.

FIG. 15 is a vertical sectional view illustrating a structural example of the fixing unit 14 of the seventh embodiment. In the configuration of the seventh embodiment, switching of magnetic paths is conducted by moving the shielding member 60, without using the center core 58. Accordingly, the arch cores 54 are linked to each other at both sides, and the shielding member 60 moves in the direction shown by an arrow in the figure along the inner surface of the arch cores 54.

The fixing unit 14 of the seventh embodiment is provided with a drive mechanism (not shown in the figure) similar to that of the first embodiment, and the shielding member 60 can be moved by the drive mechanism around the central point identical to the rotation center of the heat roller 46.

[First Path]

Where the shielding member 60 is moved to a retracted position between the arch core 54 and the inductive heating coil 52, which is a position displaced from the winding center L of the inductive heating coil 52, as shown by a two-dot dash line in FIG. 15, in the seventh embodiment, a state is assumed in which the magnetic path is switched to the first path. In this case, the magnetic flux reaches the heating belt 48 and heat roller 46 from the central position of the arch core 54 along the winding center L. Thus, the magnetism adjustment member 90 causes the magnetic flux to pass effectively in the same manner as in the first embodiment.

Further, in the seventh embodiment, the magnetism adjustment member 90 may be disposed inside, rather than outside the inductive heating coil 52, as shown by a two-dot dash line in FIG. 15.

[Second Path]

Where the shielding member 60 is positioned on the line of the winding center L of the inductive heating coil 52, as shown by a solid line in FIG. 15, a state is assumed in which the magnetic path is switched from the first path to the second path. In this case, the magnetic flux Φ1 entering the central ring-shaped portion 90A of the magnetism adjustment member 90 becomes zero. Therefore, the entire magnetism adjustment member 90 can shield the magnetic flux.

Eighth Embodiment

Figure 16:
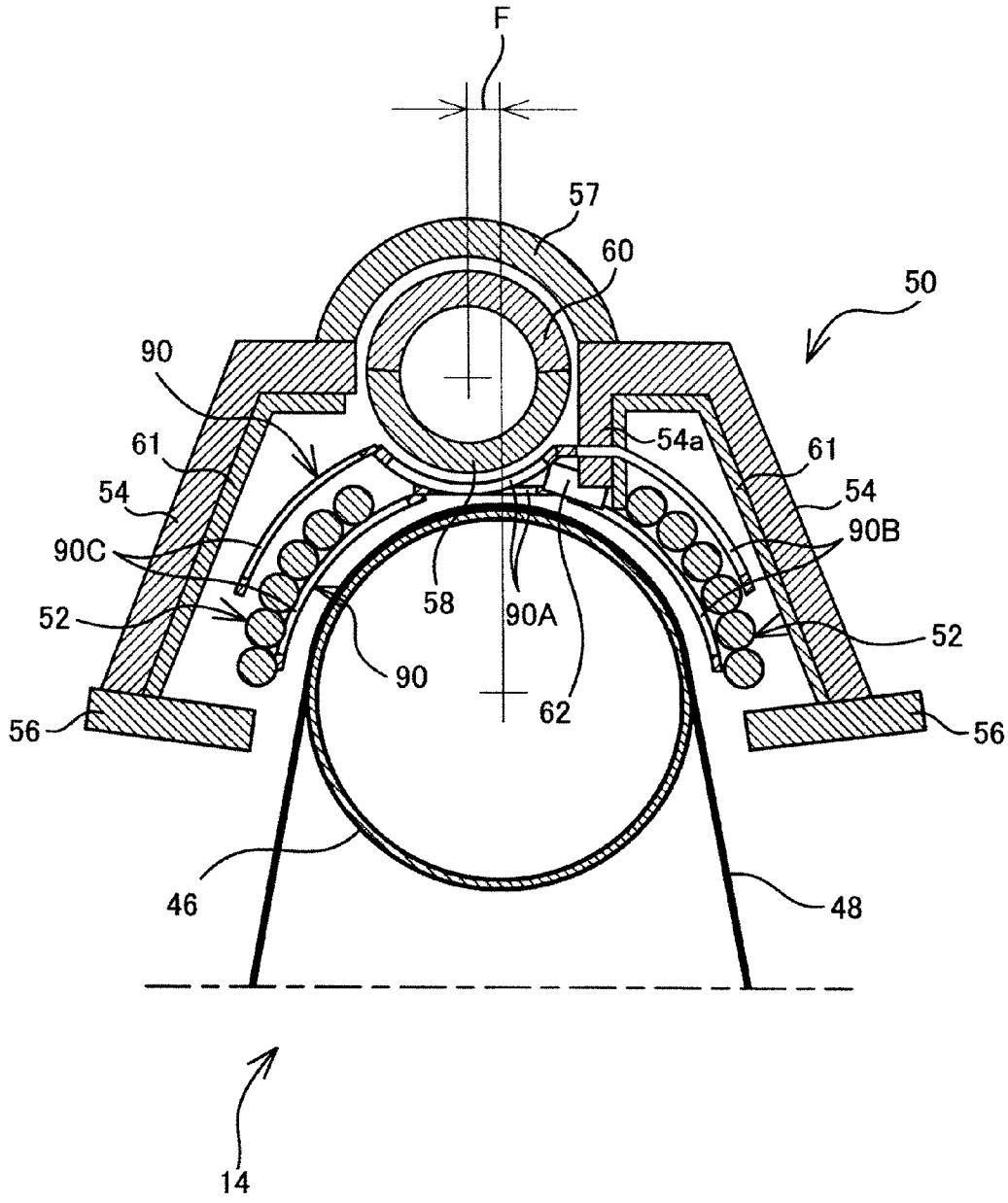
FIG. 16 is a vertical sectional view illustrating the eighth embodiment of the fixing unit.

FIG. 16 is a partial vertical sectional view illustrating a configuration example of the fixing unit 14 of the eighth embodiment. Only part of the IH coil unit 50 of the fixing unit 14 is shown in an enlarged view in FIG. 16. The explanation below is focused on the difference between this embodiment and the first embodiment. In the eighth embodiment, a separate linking core 57 is disposed outside the center core 58, and the linking core 57 links together the arch cores 54 at both sides. Further, in one (right in the figure) of the arch cores 54 at both sides, one end is curved at an almost right angle sidewise of the center core 58, and the curved portion extends inside the inductive heating coil 52 and reaches the vicinity of the heating belt 48 and heat roller 46.

For this reason, in the eighth embodiment, the rotation center of the center core 58 is in a position that is offset (F in the figure) to one side (left side in the figure) with respect to the rotation center of the heat roller 46 to the extent corresponding to the curve portion provided in the arch core 54 on one side. Further, the shielding member 60 is provided in the center core 58 over an almost half thereof as viewed in the circumferential direction of the center core. The magnetism adjustment member 90 is disposed inside, rather than outside the inductive heating coil 52, as shown in the seventh embodiment. In this case, the curve portion of the arch core 54 is assumed to be disposed, for example, in a position passing through the ring-shaped portion 90C at one side of the magnetism adjustment member 90.

In the eighth embodiment, switching between the first path and second path can be also performed by rotating the center core 58, in the same manner as in the first embodiment. With the configuration of the eighth embodiment, the degree of magnetic coupling in the case of switching to the second path can be increased by providing the arch core 54 with the curved portion. Further, a separate shielding member 60 is bonded, for example, to the inner surface of the arch core 54, and such a shielding member 61 participates in shielding the leakage magnetic flux from the arch core 54.

Therefore, in the eighth embodiment, when the magnetic path is switched from the first path to the second path, the magnetic fluxes Φ2, Φ2' can be reliably directed towards the ring-shaped portions 90B, 90C at both sides of the magnetism adjustment member 90. Therefore, the shielding effect herein can be reliably demonstrated. FIG. 16 illustrates an example in which the curve portion is provided in one arch core 54, but the curved portions may be also provided in both arch cores 54.

Ninth Embodiment

Figure 17:
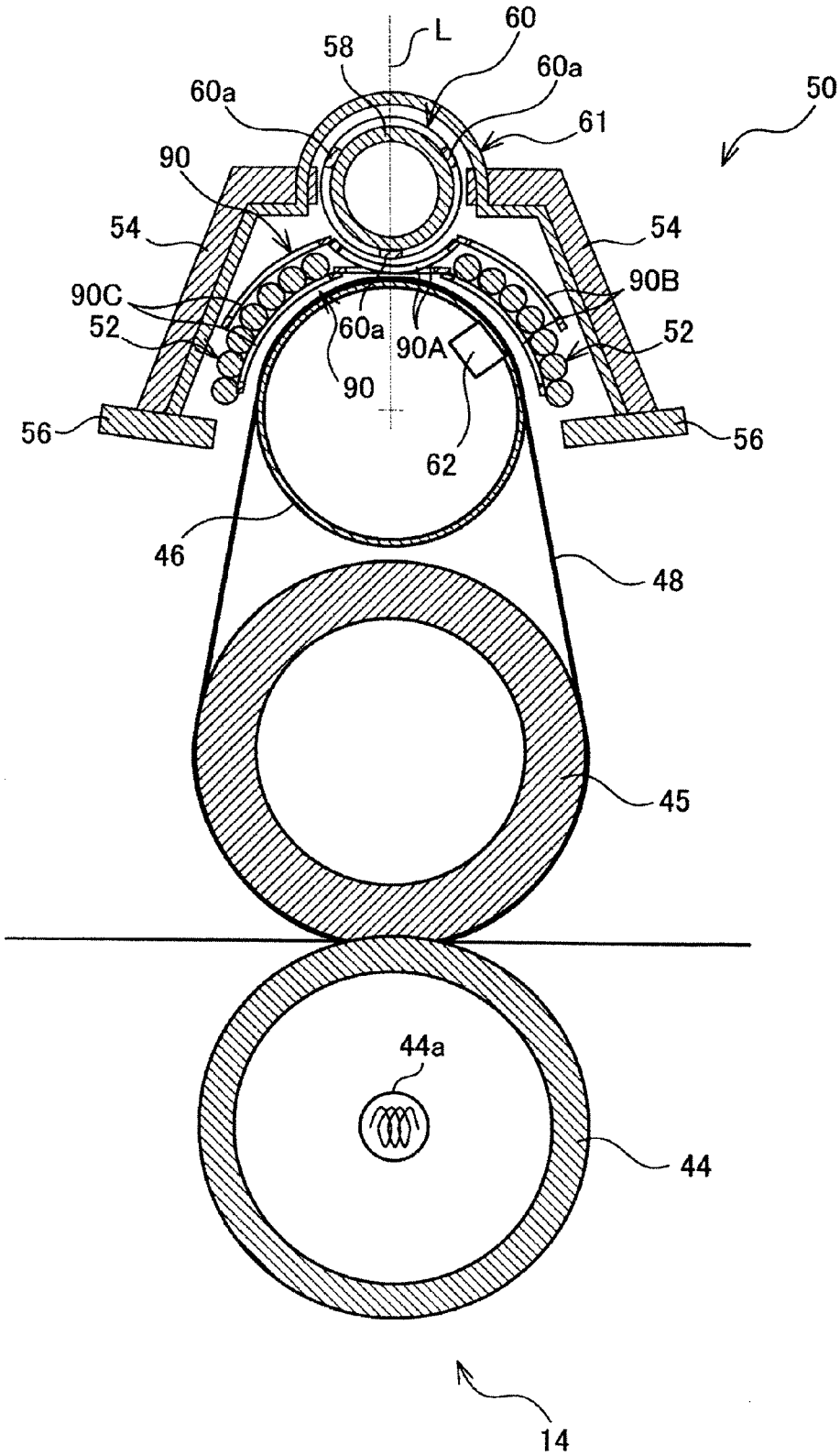
FIG. 17 is a vertical sectional view illustrating the ninth embodiment of the fixing unit.

FIG. 17 is a vertical sectional view illustrating a configuration example of the fixing unit 14 of the ninth embodiment. The explanation below is focused on the difference between this embodiment and the first embodiment. A major difference between the ninth embodiment and the first embodiment is that the shielding member 60 has a ring shape. Another difference with the first embodiment is that the magnetism adjustment member 90 is disposed outside and inside the inductive heating coil 52 in the same manner as in the eighth embodiment. Further, separate shielding members 61 are bonded to the inner surface of the arch cores 54, and the leakage magnetic flux from the arch cored 54 is shielded by the shielding members 61. The shielding members 61 extend from the arch cores 54 at both sides to the outside (upward in the figure) of the center core 58 and are joined together in this position.

[Ring-Shaped Shielding Member]

Figure 18A:
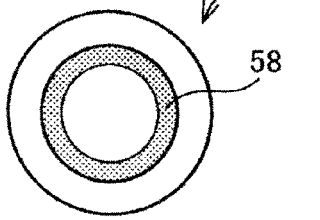
FIGS. 18A to 18D show the states in which the shielding member corresponding to the structural example (2) is attached to the center core.
Figure 18A:
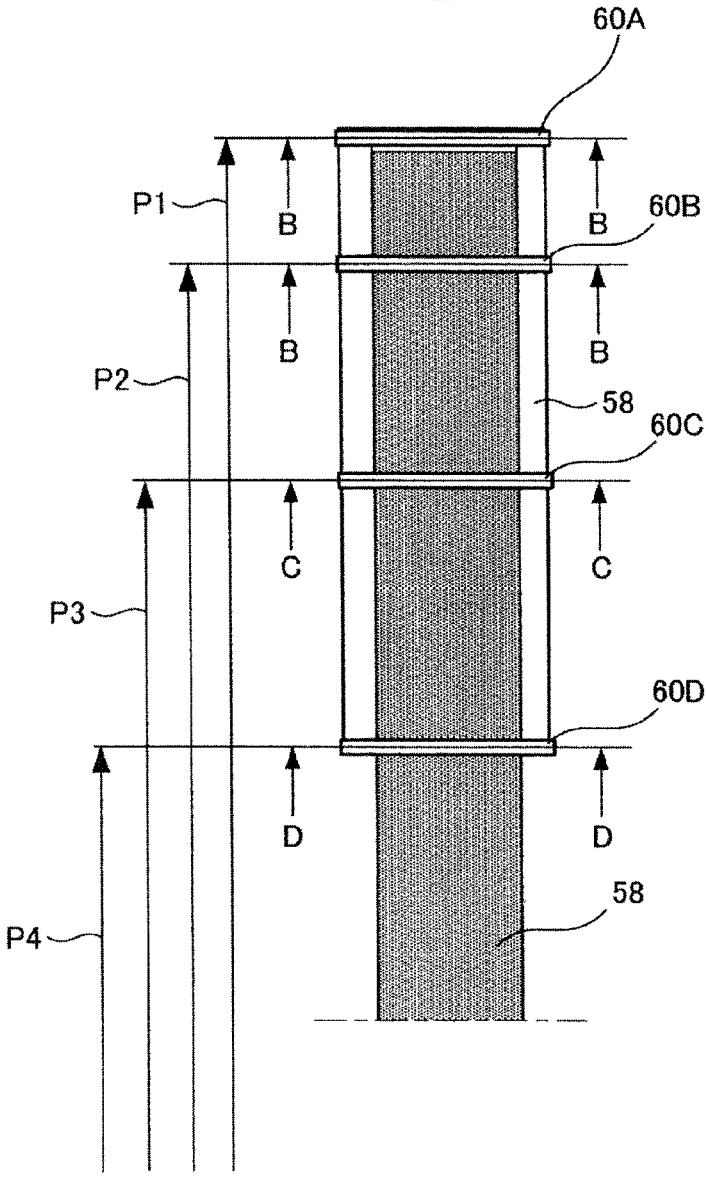
Figure 18B:
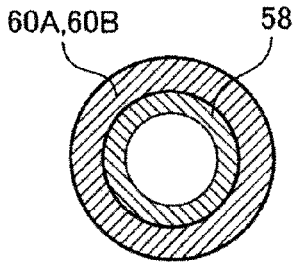
Figure 18C:
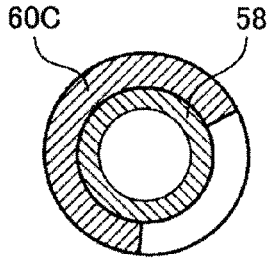
Figure 18D:
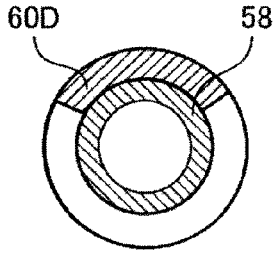
Figure 19:
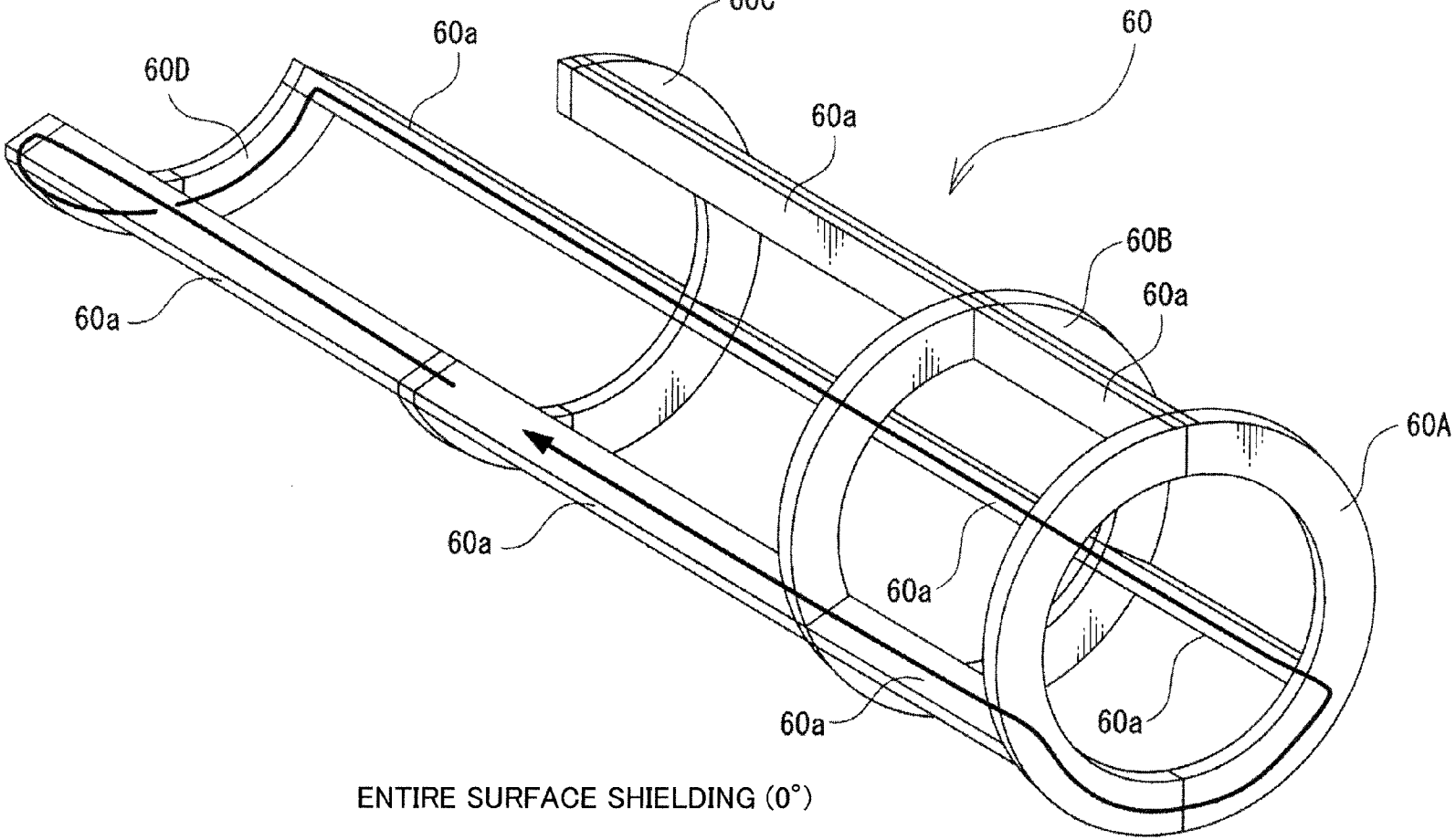
FIG. 19 is a perspective view illustrating an operation example of the shielding member.

FIGS. 18A to 18D illustrate a state in which the ring-shaped shielding member 60 that can be adapted to the structural example (2) is attached to the center core 58. FIG. 18A corresponds to the plan view and side view of the center core 58. FIGS. 18B, 18C, and 18D correspond to the B-B section, C-C section, and D-D section in the figure. The shielding member 60 as a whole has a reel-like shape and has a pair of annular portions 60A, 60B each having a hole, as viewed in the longitudinal direction thereof. In this structure, the annular portions 60A, 60B are joined by three linear portions 60*a* as shown in FIG. 19.

The linear portions 60*a* are disposed in spacing in the circumferential direction of the annular portions 60A, 60B. Further, the annular portion 60A is provided in the end portion at one end of the center core 58 (outside the maximum sheet passage area: sheet non-passage area), and the annular portion 60B is provided in the boundary section of the sheet non-passage area and sheet passage area. The shielding member 60 is also similarly disposed at the other end of the center core 58 (this configuration is not shown in the figure).

A circular-arc portion 60C that takes about ⅔ of a circle is provided following the annular portion 60B at a distance therefrom in the longitudinal direction, and a circular-arc portion 60D that takes about ⅓ of a circle is provided at the other end position. From among these four annular portions 60A, 60B and circular-arc portions 60C, 60D, the three portions, namely, the annular portions 60A, 60B and circular-arc portion 60C are joined together by three linear portions 60*a*. The remaining circular-arc portion 60D at the other end portion is joined to the adjacent circular-arc portion 60C by two linear portions 60*a*.

As shown in FIG. 18A, the shielding member 60 is also provided at the end portion, as viewed in the longitudinal direction of the center core 58. In this case, the annular portion 60A that is at the largest distance from the minimum sheet passage area is in a position corresponding to the maximum size P1 (for example, A3, A4R), and the next annular portion 60B is in a position corresponding to the intermediate size P2 (for example, B4R). The next circular-arc portion 60C is in a position corresponding to the intermediate small size P3 (for example, B4). The circular-arc portion 60D in the vicinity of the minimum sheet passage area is in a position corresponding to the minimum size P4 (for example, A5R).

As shown in FIG. 18B, it is clear that the annular portions 60A, 60B have a shape having a hole, as described above. Further, as shown in FIG. 18C, the circular-arc portion 60C has a shape of about ⅔ of a circle, as described above. The cut-out portion of the circular-arc portion 60C is filled with a ferrite material such as a center core 58.

As shown in FIG. 18D, the circular-arc portion 60D has a shape of about ⅓ of a circle, as described above. In the circular-arc portion 60D, the cut-out portion is also filled with the ferrite material of the center core 58.

Operation Example

An operation example of the configuration using the shielding member 60 will be explained below. FIGS. 19 to 24 are perspective drawings illustrating sequentially six operation examples in which the shielding member 60 is used. The arrows shown by thick lines in the figures indicate a generated inductive current or a passing magnetic field. These operation examples are described below.

[Entire Surface Shielding (0°)]

FIG. 19 is a perspective view illustrating an operation example in a case in which entire surface shielding is conducted with the shielding member 60. In operation examples, the magnetic field is assumed to be generated in the direction of passing from above to below the shielding member 60. Further, in the explanation below, the state with the complete shielding shown in FIG. 19 is taken as 0°, and the displacement amount of the shielding member 60 is represented by the rotation angle from this state.

Where the shielding member 60 is moved to a rotation angle (0°) at which the circular-arc portion 60D is positioned downward, the magnetic shielding effect can be demonstrated over the entire surface in the longitudinal direction of the shielding member 60. Thus, because the ring portion of the largest shape is formed by the annular portion 60A positioned at one end, the circular-arc portion 60D positioned at the other end, and the linear portions 60*a* joining them, magnetic shielding can be performed by the entire body. In this case, overheating of the heating belt 48 and heat roller 46 can be prevented according to the minimum size P4.

[No Shielding (60°)]

Figure 20:
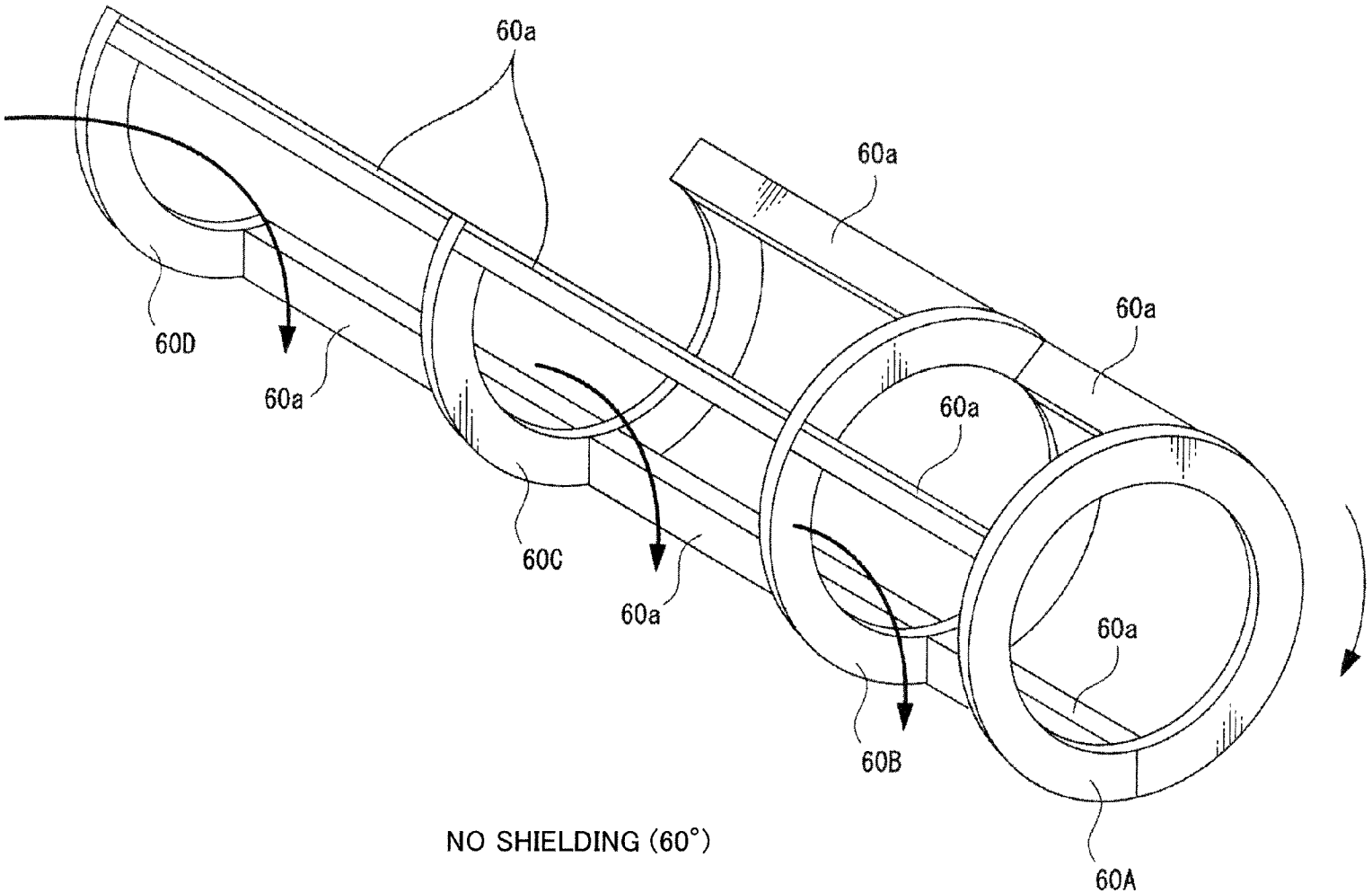
FIG. 20 is a perspective view illustrating an operation example of the shielding member.

FIG. 20 is a perspective view illustrating an operation example in which the shielding member 60 is rotated clockwise through 60° from the state shown in FIG. 19. In this case, the linear portion 60*a* is positioned on the central line of the coil (state shown in FIG. 9A), the shielding member 60 is in the retracted position, and no magnetic shielding effect is generated.

[Intermediate-Small Size Shielding (120°)]

Figure 21:
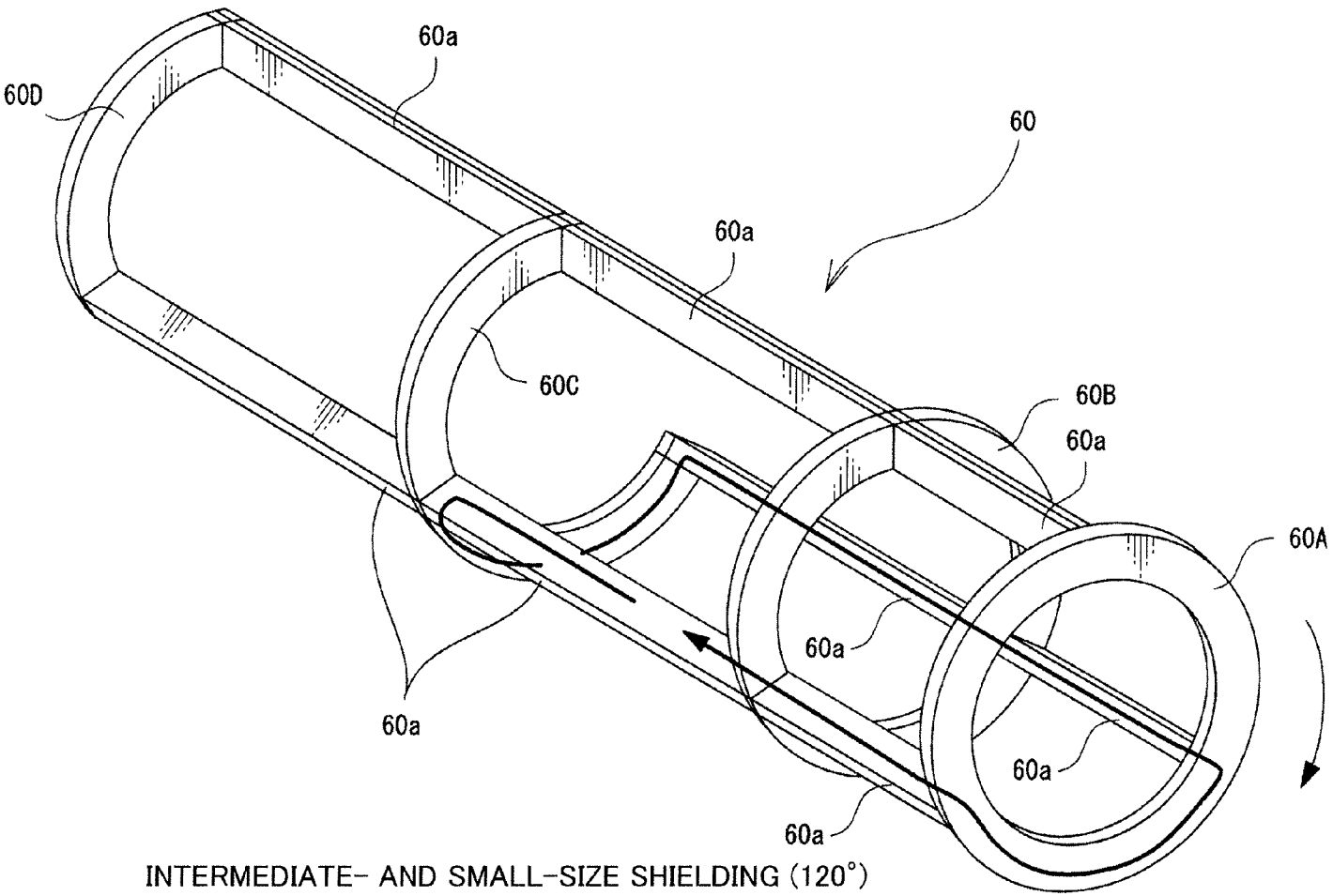
FIG. 21 is a perspective view illustrating an operation example of the shielding member.

FIG. 21 is a perspective view illustrating an operation example in which the shielding member 60 is rotated clockwise through 120° from the state shown in FIG. 19. In this case, the magnetic shielding effect can be demonstrated by one ring portion formed between the annular portion 60A and circular-arc portion 60C. In this operation example, overheating of the heating belt 48 and heat roller 46 can be prevented, for example, according to the intermediate-small size P3.

[No Shielding (180°)]

Figure 22:
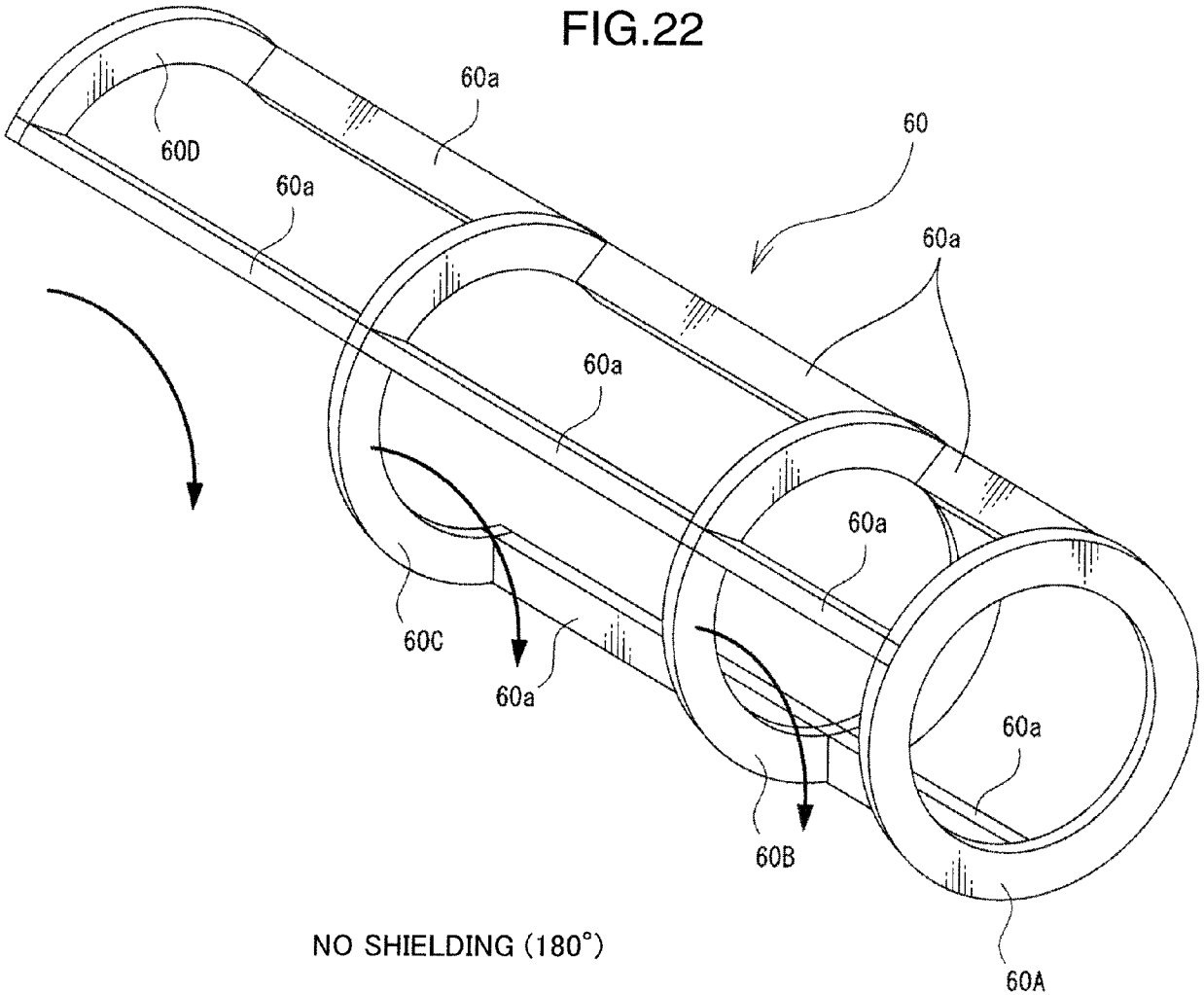
FIG. 22 is a perspective view illustrating an operation example of the shielding member.

FIG. 22 is a perspective view illustrating an operation example in which the shielding member 60 is rotated clockwise through 180° from the state shown in FIG. 19. In this case, similarly to the configuration shown in FIG. 20, the linear portion 60*a* is positioned on the central line of the coil 52 (state shown in FIG. 9A). Therefore, the shielding member 60 is in the retracted position and no magnetic shielding effect is generated.

[Intermediate Size Shielding (240°)]

Figure 23:
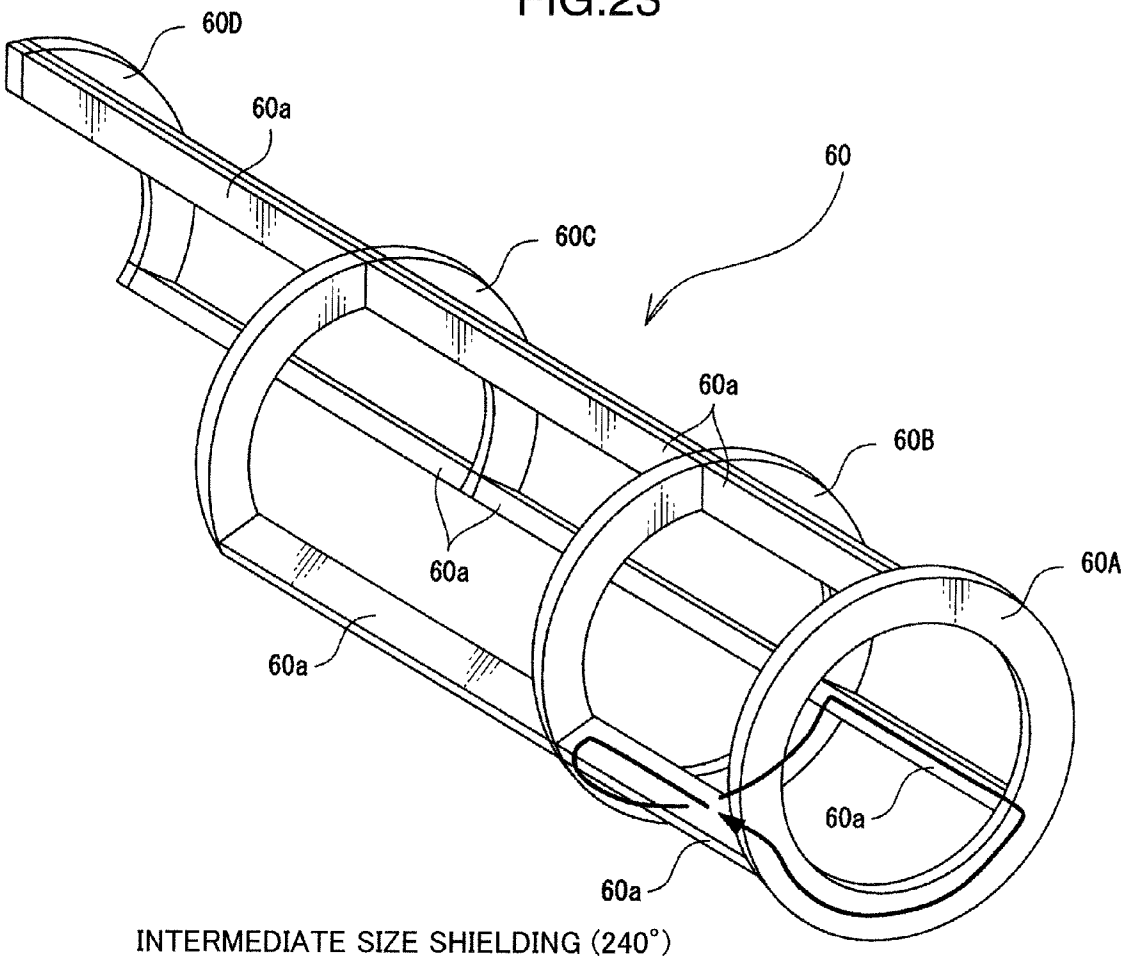
FIG. 23 is a perspective view illustrating an operation example of the shielding member.

FIG. 23 is a perspective view illustrating an operation example in which the shielding member 60 is rotated clockwise through 240° from the state shown in FIG. 19. In this case, the magnetic shielding effect can be demonstrated by one ring portion formed by the annular portion 60A and annular portion 60B. In this operation example, overheating of the heating belt 48 and heat roller 46 can be prevented, for example, according to the intermediate size P2.

[No Shielding (300°)]

Figure 24:
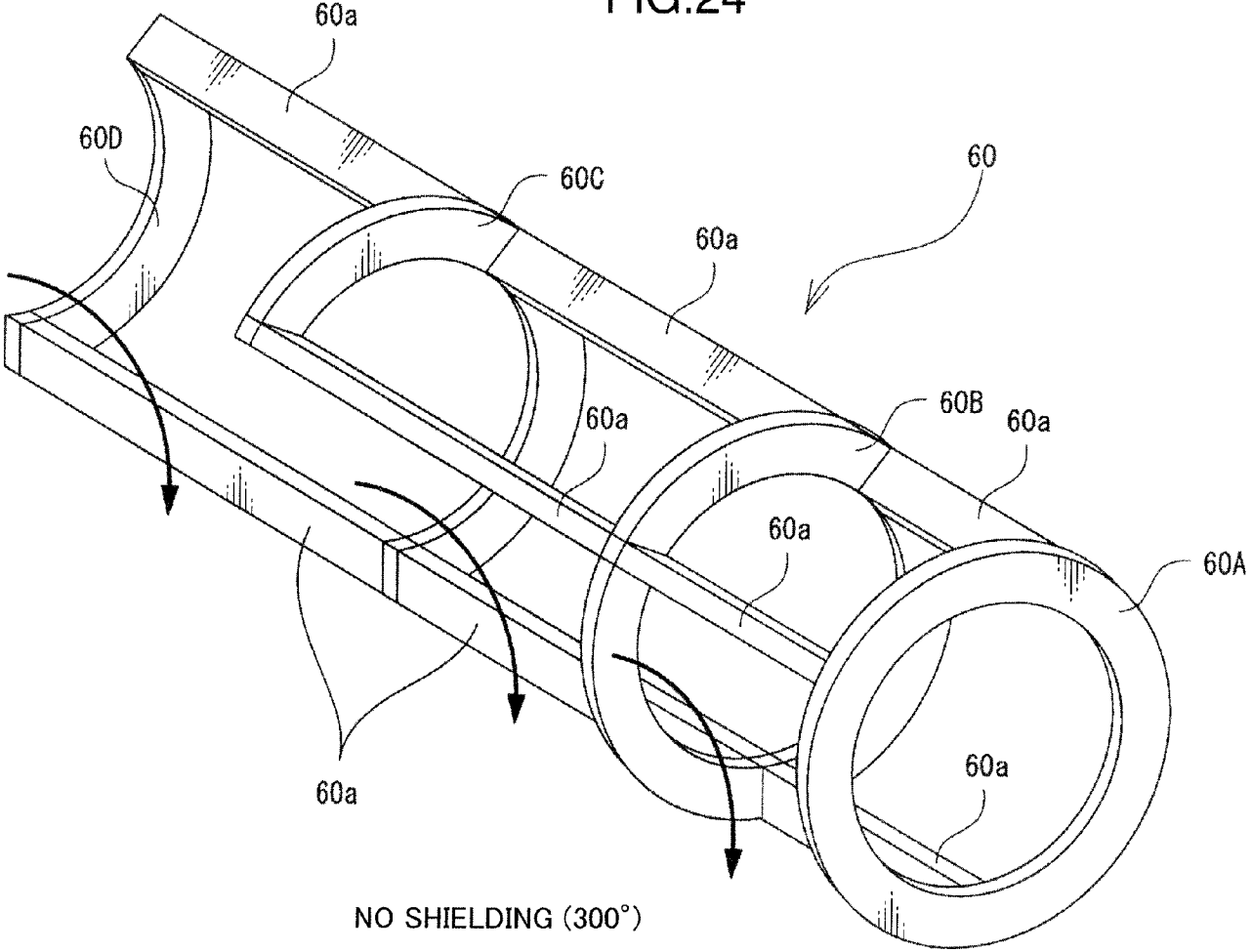
FIG. 24 is a perspective view illustrating an operation example of the shielding member.

FIG. 24 is a perspective view illustrating an operation example in which the shielding member 60 is rotated clockwise through 300° from the state shown in FIG. 19. In this case, similarly to the configurations shown in FIGS. 20 and 22, the linear portion 60*a* is positioned on the central line of the coil (state shown in FIG. 9A). Therefore, the shielding member 60 is in the retracted position and no magnetic shielding effect is generated. In the case with no shielding (60°), (180°), (300°), the heating belt 48 and heat roller 46 can be inductively heated according to the maximum size P1.

As described hereinabove, with the present embodiment, an excessive increase in temperature of the heating belt 48 is inhibited basically by switching the magnetic field path to the second path by the shielding member 60. A structural merit of such a shielding member 60 is that it does not take much space. However, the magnetic flux cannot be completely stopped from flowing by simple switching of the path and the inhibition effect of an excessive increase in temperature is not complete, as described above. Therefore, simple switching of the magnetic field path from the first path to the second path is insufficient and higher productivity cannot be realized thereby.

Accordingly, in the present embodiment, a fixedly disposed magnetism adjustment member 90 is used in addition to the shielding member 60 that saves space but demonstrates a weak magnetic shielding effect. Specifically, in a state in which the magnetic path is switched to the first path, the magnetism adjustment member 90 allows the magnetic flux to pass therethrough and the temperature increase effect of the belt 48 is maximized, but in a state in which the magnetic path is switched to the second path, the magnetic flux passage is shut out over the entire range of the magnetism adjustment member 90 and an excessive increase in temperature of the belt 48 is prevented.

As a result, during the switching between the first path and second path, the heat generation contrast of the belt 48 can be intensified. Further, since the magnetism adjustment member has a function of causing the magnetic flux to pass therethrough, while being in a fixed position, without involving any mechanical operation, and conversely shielding the magnetic flux (function similar to that of a magnetic filter), although a certain surface area is taken, no effect is produced on the magnetic field when the increase in temperature is necessary. Further, since the magnetism adjustment member 90 may be disposed fixedly, it is not necessary to provide a movable member anew and the space of the fixing device can be reduced accordingly.

Moreover, the magnetism adjustment member 90 of the present embodiment is provided with a plurality of the ring-shaped portions 90A, 90B, 90C that are formed from a wire material, and although the magnetism adjustment member is configured to be adaptable to a plurality of sheet sizes, these ring-shaped portions 90A, 90B, 90C are formed as a whole to have a continuous endless shape, as viewed in the axial direction of the wire material. As a result, it is possible to set a range in which one magnetism adjustment member 90 can inhibit heat generation in a stepwise manner with respect to the longitudinal direction of the center core 58. Further, by comparison with the conventional configuration in which the magnetism adjustment member is divided into separate portions with a space formed between the portions, which space can become a leakage path of the magnetic field, this space can be eliminated in the magnetism adjustment member 90. Therefore, the magnetic shielding effect can be further improved and the space taken by the fixing unit 14 can be reduced.

In addition, for example, when the magnetism adjustment member 90 has at least two ring-shaped portions, a structure is obtained in which the two ring-shaped portions are joined in the so-called "8-like shape". Thus, in this case, when the magnetic flux passes in the same direction through the two adjacent ring-shaped portions, the direction of inductive current generated in one ring-shaped portion 90A is opposite to the direction of inductive current generated in other ring-shaped portions 90B, 90C and a state is assumed in which the inductive current is canceled as a whole inside the magnetism adjustment member 90. In this case, the magnetism adjustment member 90 demonstrates practically no effect on the magnetic field and therefore the magnetic flux can be allowed to pass without any problem.

By contrast, when the magnetic path has been switched to the second path, the quantity of magnetic flux passing through, for example, one ring-shaped portion 90A is reduced (becomes practically zero), whereby an inductive current is generated in the other ring-shaped portions 90B, 90C and this current generates a magnetic flux (demagnetizing field) in the direction opposite that of the magnetic flux that passes through. In this case, the magnetic flux that is to pass through the second path is shielded. Therefore, eventually the entire magnetism adjustment member 90 can demonstrate a magnetic flux shielding effect.

Further, as described hereinabove, the ring-shaped portions 90A, 90B, 90C that eliminate the space between the magnetism adjustment portions M1, M2 or the magnetism adjustment portions M1, M2, M3 are disposed close to each other and an insulating treatment is performed on a surface portion of each ring-shaped portion 90A, 90B, 90C or on mutually close surface portions of the ring-shaped portions. Therefore, the ring-shaped portion 90A, 90B, 90C can be reliably insulated.

Further, the heating belt 48 has a first sheet passage area that is set according to the maximum width size of sheet and a second sheet passage area that is set according to a width side that is less than the maximum width size, induction heating is conducted by the inductive heating coil 52 over the first sheet passage area, and the plurality of ring-shaped portions 90A to 90C are disposed outside the second sheet passage area, as viewed in the longitudinal direction of the center core 58.

With such a configuration, the end portion of the heating belt 48 that serves as a sheet non-passage area according to the sheet size can be effectively prevented from an excessive increase in temperature.

Further, in the present embodiment, the heating belt 48 further has an intermediate sheet passage area that is set between the first sheet passage area and the second sheet passage portion, and each of the plurality of ring-shaped portions 90A to 90C has a ring-shaped magnetism adjustment portion M1 disposed outside the intermediate sheet passage area and a ring-shaped magnetism adjustment portion M2 that is adjacent to the magnetism adjustment portion M1 in the longitudinal direction of the center core 58 and disposed outside the second sheet passage area.

With such a configuration, the heating belt 48 can be prevented from an excessive increase in temperature outside the intermediate sheet passage area and outside the second sheet passage area.

In the present embodiment, each of the plurality of ring-shaped portions 90A-90C further has a ring-shaped magnetism adjustment portion M3 that is disposed over the boundary section of the second sheet passage area and the intermediate sheet passage area and adjacent to the magnetism adjustment portion M2 in the longitudinal direction of the center core 58.

With such a configuration, the heating belt 48 can be prevented from the increase in temperature outside the second sheet passage area.

Further, in the present embodiment, the shielding member 60 is attached to the outer surface of the center core 58, can be moved between a retracted position in which the magnetic field path is switched to the first path and a shielding position in which the magnetic field path is switched to the second path, following the rotation of the center core 58, and extends from the magnetism adjustment portion M1 along the magnetism adjustment portion M3, as viewed in the longitudinal direction of the center core 58.

With such a configuration, the shielding member 60 can shield the magnetic fluxes entering the magnetism adjustment portion M1, magnetism adjustment portion M2, and magnetism adjustment portion M3. Therefore, the magnetic flux shielding effect can be demonstrated according to the maximum sheet passage area, intermediate sheet passage area, and minimum sheet passage area.

Further, in the present embodiment, the shielding member has a length extending in the circumferential direction of the center core 58, and the ratio of that length to the outer circumferential length of the center core 58 decreases from the magnetism adjustment portion M1 towards the magnetism adjustment portion M3, as viewed in the longitudinal direction of the center core 58.

With such a configuration, the magnetic shielding amount can be easily decreased with a larger sheet size and can be easily increased with a smaller sheet size.

Further, with the present embodiment, the magnetism adjustment member 90 has one ring-shaped portion 90A in the center and two ring-shaped portions 90B, 90C adjacent to both sides thereof. Therefore, the magnetism adjustment member 90 can obtain a structure corresponding to each of the sheet sizes. In this case, a state is assumed in which the central ring-shaped portion 90A is disposed on the extension line of the winding center C of the coil, and the other ring-shaped portions 90B, 90C are disposed on both sides thereof.

In a state in which the magnetic path has been switched to the first path by the shielding member 60, the relationship between the first inductive current generated in one ring-shaped portion 90A in the center by the magnetic flux passing through the first path and the second inductive current generated when the magnetic flux that is to bypass the first path and pass in the second paths positioned on both sides thereof passes through the other two ring-shaped portions 90B, 90C adjacent thereto is such that the inductive currents cancel each other. As a result, the magnetism adjustment member 90 allows the passage of not only the magnetic flux passing in the first path, but also the magnetic flux that is to pass in the second paths that are at both sides of the first path. Therefore, the passage of magnetic flux can be allowed within the entire magnetic field including the first and second magnetic paths.

When the magnetic path has been switched by the shielding member 60 to the second path, the magnetic flux practically does not pass in one central ring-shaped portion 90A, the respective magnetic fluxes pass through other two ring-shaped portions 90B, 90C adjacent thereto and an inductive current is generated. In this case, the respective magnetic fluxes generated in the other two ring-shaped portions 90B, 90C cancel the magnetic flux that is to pass through the second path. As a result, the magnetism adjustment member 90 can shield the magnetic flux within the entire magnetic field including the first and second magnetic paths. Further, by inhibiting the passage of the magnetic flux through the one ring-shaped portion 90A disposed in the center, it is possible to demonstrate a magnetic flux shielding effect in the two ring-shaped portions 90B, 90C disposed on both sides of the ring-shaped portion 90A. Therefore, the shielding effect can be efficiently obtained with a simple structure.

As described hereinabove, the magnetic shielding effect can be further improved. Therefore, a good toner image can be formed. As a result, reliability of the image forming apparatus 1 is increased.

The present invention is not limited to the above-described embodiment and can be changed variously. For example, the center core 58 is not limited to the cylindrical cross-sectional shape and can be of a round columnar shape or polygonal shape. The shielding member 60 is not limited to a triangular shape and may be of a trapezoidal shape in the plan view thereof.

Further, the ring shape and size of the magnetism adjustment members 90 presented in the embodiments and the division number thereof are merely exemplary and not particularly limited to those in one embodiment. The specific form of each component, including the arch cores 54 and side cores 56, is not limited to that shown in the figure and can be changed appropriately. In any of these cases, the magnetic shielding effect can be further improved in the same manner as described above.

This application is based on Japanese Patent Application Serial No. 2009-105794, filed in Japan Patent Office on Apr. 24, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A fixing device comprising:

a heating member;

a pressing member;

the heating member and the pressing member fixing a toner image to a sheet by heat from the heating member while conveying the sheet having the toner image transferred thereto in a sandwiched state, a coil arranged along an outer surface of the heating member and generating a magnetic field to induction heat the heating member;

a magnetic core arranged around the coil to form a magnetic path between the heating member and the magnetic core, and guiding the magnetic field generated by the coil to the heating member;

a path switching member switching the magnetic path between a first path in which the induction heating of the heating member is promoted and a second path in which the induction heating of the heating member is inhibited; and a magnetism adjustment member fixedly arranged over a range of the magnetic field including the first path and the second path;

the magnetism adjustment member being configured to allow a passage of a magnetic flux from the magnetic core towards the heating member within the magnetic field range when the magnetic path is switched by the path switching member to the first path, and to shield the magnetic flux without allowing the passage of the magnetic flux within the magnetic field range when the magnetic path is switched to the second path, wherein the magnetism adjustment member has a plurality of ring-shaped portions that are formed from a single wire material having an endless shape, and each of the ring-shaped portions extends in a longitudinal direction of the magnetic core according to a size of the sheet.

2. The fixing device according to claim 1, wherein respective surface portions of the ring-shaped portions, or mutually adjoining surface portions of the ring-shaped portions are subjected to an insulating treatment.

3. The fixing device according to claim 1, wherein the wire material is a material with electric conductivity, the plurality of ring-shaped portions are mutually connected to adjoin in a direction intersecting with a traveling direction of the magnetic flux, and are structured such that when the magnetic path is switched to the first path by the path switching member, respective inductive currents generated by the magnetic flux passing through inside each of the ring-shaped portions flow in mutually opposite directions between the adjoining ring-shaped portions, and the path switching member decreases an amount of the magnetic flux passing through at least one of the ring-shaped portions when switching the magnetic path to the second path.

4. The fixing device according to claim 3, wherein the magnetic core has a pair of first cores that are arranged at opposite sides of a winding center of the coil to form the magnetic path, and a second core that is arranged between the first cores to form the magnetic path reaching the heating member through the winding center, the path switching member allows the magnetic flux to pass from the second core to the heating member along the winding center when switching the magnetic path to the first path and causes the magnetic flux to pass from the first core to the heating member at opposite positions of the winding center offset from the winding center when switching the magnetic path to the second path, and the magnetism adjustment member has one of the ring-shaped portions arranged on the first path passing through the winding center within the magnetic field range and also has remaining two ring-shaped portions that are arranged on the second path at opposite positions of the one of the ring-shaped portion and adjoin the one of the ring-shaped portion from opposite sides.

5. The fixing device according to claim 1, wherein the heating member has a first sheet passage area that is set according to a maximum width size of sheet and a second sheet passage area that is set according to a width size smaller than the maximum width size, and is induction heated by the coil over the first sheet passage area, and the ring-shaped portions are arranged outside the second sheet passage area when viewed in the longitudinal direction of the magnetic core.

6. The fixing device according to claim 5, wherein the heating member further has an intermediate sheet passage area that is set between the first sheet passage area and the second sheet passage area, and each of the ring-shaped portions has a ring-shaped first magnetism adjustment portion arranged outside the intermediate sheet passage area and a ring-shaped second magnetism adjustment portion that adjoins the first magnetism adjustment portion in the longitudinal direction of the magnetic core and is arranged outside the second sheet passage area.

7. The fixing device according to claim 6, wherein each of the ring-shaped portions further has a ring-shaped third magnetism adjustment portion that is arranged over a boundary section between the second sheet passage area and the intermediate sheet passage area and adjoins the second magnetism adjustment portion in the longitudinal direction of the magnetic core.

8. The fixing device according to claim 7, wherein the magnetic core has a pair of first cores that are arranged at opposite sides of a winding center of the coil to form the magnetic path, and a second core that is arranged between the first cores to form the magnetic path reaching the heating member through the winding center;

the second core is configured to be rotatable, and the path switching member is attached to an outer surface of the second core, and is capable of moving, in response to the rotation of the second core, between a retracted position in which the magnetic path is switched to the first path and a shielding position in which the magnetic path is switched to the second path, and extends from the first magnetism adjustment portion to the third magnetism adjustment portion when viewed in the longitudinal direction of the second core.

9. The fixing device according to claim 8, wherein the path switching member has a length extending in a circumferential direction of the second core, and a ratio of that length to the outer circumferential length of the second core decreases from the first magnetism adjustment portion towards the third magnetism adjustment portion when viewed in the longitudinal direction of the second core.

10. An image forming apparatus comprising:

an image forming unit forming a toner image on a sheet; and a fixing device fixing the toner image on the sheet to the sheet, the fixing device including:

a heating member;

a pressing member;

the heating member and the pressing member fixing a toner image to a sheet by heat from the heating member while conveying the sheet having the toner image transferred thereto in a sandwiched state, a coil arranged along an outer surface of the heating member and generating a magnetic field to induction heat the heating member;

a magnetic core arranged around the coil to form a magnetic path between the heating member and the magnetic core, and guiding the magnetic field generated by the coil to the heating member;

a path switching member switching the magnetic path between a first path in which the induction heating of the heating member is promoted and a second path in which the induction heating of the heating member is inhibited; and a magnetism adjustment member fixedly arranged over a range of the magnetic field including the first path and the second path;

the magnetism adjustment member being configured to allow a passage of a magnetic flux from the magnetic core towards the heating member within the magnetic field range when the magnetic path is switched by the path switching member to the first path, and to shield the magnetic flux without allowing the passage of the magnetic flux within the magnetic field range when the magnetic path is switched to the second path, wherein the magnetism adjustment member has a plurality of ring-shaped portions that are formed from a single wire material having an endless shape, and each of the ring-shaped portions extends in a longitudinal direction of the magnetic core according to a size of the sheet.

11. The image forming apparatus according to claim 10, wherein respective surface portions of the ring-shaped portions, or mutually adjoining surface portions of the ring-shaped portions are subjected to an insulating treatment.

12. The image forming apparatus according to claim 10, wherein the wire material is a material with electric conductivity, the plurality of ring-shaped portions are mutually connected to adjoin in a direction intersecting with a traveling direction of the magnetic flux, and are structured such that when the magnetic path is switched to the first path by the path switching member, respective inductive currents generated by the magnetic flux passing through inside each of the ring-shaped portions flow in mutually opposite directions between the adjoining ring-shaped portions, and the path switching member decreases an amount of the magnetic flux passing through at least one of the ring-shaped portions when switching the magnetic path to the second path.

13. The image forming apparatus according to claim 12, wherein the magnetic core has a pair of first cores that are arranged at opposite sides of a winding center of the coil to form the magnetic path, and a second core that is arranged between the first cores to form the magnetic path reaching the heating member through the winding center, the path switching member allows the magnetic flux to pass from the second core to the heating member along the winding center when switching the magnetic path to the first path and causes the magnetic flux to pass from the first core to the heating member at opposite positions of the winding center offset from the winding center when switching the magnetic path to the second path, and the magnetism adjustment member has one of the ring-shaped portions arranged on the first path passing through the winding center within the magnetic field range and also has remaining two ring-shaped portions that are arranged on the second path at opposite positions of the one of the ring-shaped portion and adjoin the one of the ring-shaped portion from opposite sides.

14. The image forming apparatus according to claim 10, wherein the heating member has a first sheet passage area that is set according to a maximum width size of sheet and a second sheet passage area that is set according to a width size smaller than the maximum width size, and is induction heated by the coil over the first sheet passage area, and the ring-shaped portions are arranged outside the second sheet passage area when viewed in the longitudinal direction of the magnetic core.

15. The image forming apparatus according to claim 14, wherein the heating member further has an intermediate sheet passage area that is set between the first sheet passage area and the second sheet passage area, and each of the ring-shaped portions has a ring-shaped first magnetism adjustment portion arranged outside the intermediate sheet passage area and a ring-shaped second magnetism adjustment portion that adjoins the first magnetism adjustment portion in the longitudinal direction of the magnetic core and is arranged outside the second sheet passage area.

16. The image forming apparatus according to claim 15, wherein each of the ring-shaped portions further has a ring-shaped third magnetism adjustment portion that is arranged over a boundary section between the second sheet passage area and the intermediate sheet passage area and adjoins the second magnetism adjustment portion in the longitudinal direction of the magnetic core.

17. The image forming apparatus according to claim 16, wherein the magnetic core has a pair of first cores that are arranged at opposite sides of a winding center of the coil to form the magnetic path, and a second core that is arranged between the first cores to form the magnetic path reaching the heating member through the winding center;

the second core is configured to be rotatable, and the path switching member is attached to an outer surface of the second core, and is capable of moving, in response to the rotation of the second core, between a retracted position in which the magnetic path is switched to the first path and a shielding position in which the magnetic path is switched to the second path, and extends from the first magnetism adjustment portion to the third magnetism adjustment portion when viewed in the longitudinal direction of the second core.

18. The image forming apparatus according to claim 17, wherein the path switching member has a length extending in a circumferential direction of the second core, and a ratio of that length to the outer circumferential length of the second core decreases from the first magnetism adjustment portion towards the third magnetism adjustment portion when viewed in the longitudinal direction of the second core.

* * * * *